US007283108B2

(12) United States Patent
Kasai

(10) Patent No.: US 7,283,108 B2
(45) Date of Patent: Oct. 16, 2007

(54) ELECTRO-OPTICAL DEVICE, METHOD OF DRIVING ELECTRO-OPTICAL DEVICE, AND ELECTRONIC APPARATUS

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 588 days.

(21) Appl. No.: 10/722,454

(22) Filed: Nov. 28, 2003

(65) Prior Publication Data

US 2004/0155841 A1 Aug. 12, 2004

(30) Foreign Application Priority Data

Nov. 27, 2002 (JP) ..... 2002-343964
Sep. 29, 2003 (JP) ..... 2003-337850

(51) Int. Cl.
*G09G 3/30* (2006.01)

(52) U.S. Cl. ..... 345/76; 345/82; 345/83; 345/204; 315/169.3

(58) Field of Classification Search ..... 345/76, 345/82–83, 204; 315/169.3
See application file for complete search history.

(56) References Cited

U.S. PATENT DOCUMENTS 6,788,277 B2 * 9/2004 Kanauchi et al. ..... 345/77
6,859,193 B1 * 2/2005 Yumoto ..... 345/82

FOREIGN PATENT DOCUMENTS

EP 1 130 565 A1 9/2001
JP A 06-348224 12/1994
JP A 09-034412 2/1997
JP A 2001-060076 3/2001
JP A 2001-060078 3/2001
JP A 2001-147659 5/2001
JP A 2002-156950 5/2002
JP A 2003-216100 7/2003
WO WO98/48403 10/1998

* cited by examiner

*Primary Examiner*—Richard Hjerpe
*Assistant Examiner*—Leonid Shapiro
(74) *Attorney, Agent, or Firm*—Oliff & Berridge, PLC

(57) ABSTRACT

The invention provides a device that accomplishes an improvement of overall display quality by employing drive modes depending upon display targets in an electro-optical device employing electro-optical elements for emitting light with a brightness corresponding to a driving current. More particularly, when a first drive mode is selected as a drive mode, a drive mode selecting circuit drives the electro-optical elements for a first light emitting time period shorter than a time period from a time point at which the scanning line corresponding to the pixel in which data should be written is selected to a time point at which the scanning line is next selected. In addition, when a second drive mode other than the first drive mode is selected as a drive mode, the drive mode selecting circuit drives the electro-optical element for a second light emitting time period longer than the first light emitting time period in the time period from a time point at which the scanning line corresponding to the pixel in which data should be written is selected to a time point at which the scanning line is next selected.

19 Claims, 20 Drawing Sheets

ELECTRO-OPTICAL DEVICE, METHOD OF DRIVING ELECTRO-OPTICAL DEVICE, AND ELECTRONIC APPARATUS

BACKGROUND OF THE INVENTION

1. Field of Invention

The present invention relates to an electro-optical device, a method of driving the electro-optical device and an electronic apparatus, employing an electro-optical element whose luminescent brightness is controlled by means of current, and more specifically to a technology of selecting drive modes of pixels.

2. Description of Related Art

Recently, flat panel displays (FPD) employing organic electroluminescent (EL) elements have been given attention. An organic EL element is a typical current driven element that is driven by current flowing in the element, and spontaneously emits light with a brightness corresponding to a level of the current. A driving method of an active matrix type display employing organic EL elements can be classified roughly into a voltage programming method and a current programming method.

For example, in Japanese Unexamined Patent Application Publication No. 2001-60076 relating to the voltage programming method, a pixel circuit in which a transistor (TFT 3 shown in FIG. 5 of Japanese Unexamined Patent Application Publication No. 2001-60076) for cutting off a current path is provided in the current path for supplying a driving current to an organic EL element is disclosed. The transistor is controlled into the on state in a former part of one frame period, and also is controlled into the off state in a latter part thereof. Therefore, in the former period when the transistor is turned on, and thus the driving current flows, the organic EL element emits light with a brightness corresponding to a level of the current. Further, in the latter period when the transistor is turned off and thus the driving current is cut off, since the organic EL element is forcibly put out, a black color is displayed. This technique is called 'blinking', and using this technique, a residual image felt by a human eye is broken off, so that it is possible to accomplish improvement in display quality of a moving picture.

For example, in Japanese Unexamined Patent Application Publication No. 2001-147659 and PCT Japanese Translation Patent Publication No. 2002-514320, constructions of a pixel circuit employing the current programming method are disclosed. In JP 659, a pixel circuit employing a current mirror circuit comprised of a pair of transistors is disclosed. In patent JP 320, a pixel circuit capable of reducing the variation of threshold voltage and the ununiformity of current in a driving transistor as a setting source of the driving current to be supplied to the organic EL element is disclosed.

SUMMARY OF THE INVENTION

In general, in many cases of driving a display, the overall display area is driven in the same drive mode. However, from the viewpoint of improvement of display quality, it is preferable that different drive modes be selectively applied depending upon display targets. For example, a hold driving is suitable for an area in which a text is displayed, and an impulse driving is suitable for an area in which a moving picture is displayed. Therefore, when the area in which the text is displayed and the area in which the moving picture is displayed are mixed in the whole display unit, it is preferable that the hold driving be performed in the former display area, and the impulse driving be performed in the latter display area. Further, when a moving picture having an arbitrary resolution is displayed in equimultiples in the display unit having a larger resolution, the impulse driving is suitable for the moving picture area at the center of the display unit, but the hold driving is suitable for the areas other than the moving picture area. Therefore, in this case, it is also preferable that different drive modes be used depending upon the display areas.

The present invention is contrived in consideration of the above problems, and it is an object of the present invention to accomplish improvement of the overall display quality by employing different drive modes depending upon display targets in an electro-optical display device employing an electro-optical element emitting light with a brightness corresponding to a driving current.

In order to accomplish the above object, a first invention provides an electro-optical device having a plurality of scanning lines, a plurality of data lines, a plurality of pixels correspondingly provided to intersections of the scanning lines and the data lines, a scanning line driving circuit for selecting the scanning line corresponding to the pixel in which data should be written, by outputting a scanning signal to the scanning lines, a data line driving circuit for cooperating with the scanning line driving circuit to output data to the data line corresponding to the pixel in which data should be written, and a drive mode selecting circuit for selecting a drive mode of each of the plurality of pixels constituting a display unit. Here, each of the plurality of pixels has a capacitor to which data writing is performed, a driving transistor for setting a driving current in accordance with the data written to the capacitor, and an electro-optical element for emitting light with a brightness corresponding to the set driving current. When a first drive mode is selected as the drive mode, the drive mode selecting circuit drives the electro-optical element for a first light emitting time period shorter than a time period from a time point at which the scanning line corresponding to the pixel in which data should be written is selected to a time point at which the scanning line is next selected. Further, when a second drive mode other than the first drive mode is selected as the drive mode, the drive mode selecting circuit drives the electro-optical element for a second light emitting time period longer than the first light emitting time period in the time period from a time point at which the scanning line corresponding to the pixel in which data should be written is selected to a time point at which the scanning line is next selected.

In the invention, the drive mode selecting circuit may impulse-drive the electro-optical element when the first drive mode is selected, and may hold-drive the electro-optical element when the second drive mode is selected.

In the invention, each of the pixels may further have a control transistor provided in a current path of the driving current to be supplied to the electro-optical element. In this case, it is preferable that the drive mode selecting circuit drives the electro-optical element in the first drive mode and the electro-optical element in the second drive mode, by controlling an on/off state of the control transistor in the time period from a time point at which the scanning line corresponding to the pixel in which data should be written is selected to a time point at which the scanning line is next selected. Further, when the first drive mode is selected, the drive mode selecting circuit may impulse-drive the electro-optical element, by repeatedly cutting off the current path of the driving current using the control transistor in the time period from a time point at which the scanning line corresponding to the pixel in which data should be written is selected to a time point at which the scanning line is next selected. On the other hand, when the second drive mode is selected, the drive mode selecting circuit may hold-drive the electro-optical element, by holding the current path of the driving current using the control transistor in the time period from a time point at which the scanning line corresponding to the pixel in which data should be written is selected to a time point at which the scanning line is next selected.

In the invention, when the first drive mode is selected, the drive mode selecting circuit may impulse-drive the electro-optical element, by supplying the driving current to the electro-optical element in accordance with the data written to the capacitor and then erasing the data written to the capacitor in the time period from a time point at which the scanning line corresponding to the pixel in which data should be written is selected to a time point at which the scanning line is next selected. Further, when the second drive mode is selected, the drive mode selecting circuit may hold-drive the electro-optical element, by continuously supplying the driving current to the electro-optical element in accordance with the data written to the capacitor in the time period from a time point at which the scanning line corresponding to the pixel in which data should be written is selected to a time point at which the scanning line is next selected.

In the invention, the data line driving circuit may output the data as a data current to the data lines, and each of the pixels may further have a programming transistor. In this case, it is preferable that the programming transistor carry out the data writing to the capacitor on the basis of a gate voltage generated due to the data current flowing in a channel of the programming transistor. Further, the driving transistor may also serve as the programming transistor.

In the invention, the data line driving circuit may output the data as a data voltage to the data line, and the data writing to the capacitor may be carried out on the basis of the data voltage.

In the invention, the drive mode selecting circuit may select the drive mode every area or plural scanning lines, but may output a pulse signal of controlling the driving of the electro-optical element on the basis of a drive mode signal of specifying the drive mode in a unit of scanning line. In this case, the drive mode selecting circuit outputs a signal having a pulse shape in which a high level and a low level are alternately repeated as the pulse signal when the first drive mode is selected. Further, the drive mode selecting circuit outputs a signal having a waveform other than that in the first drive mode as the pulse signal when the second drive mode is selected.

In the invention, the drive mode selecting circuit may include a flip flop for holding a level of the drive mode signal at a timing when the scanning signal is varied, a selecting section for selecting and outputting any one of a first driving signal having a pulse shape in which a high level and a low level are alternately repeated and a second driving signal having a waveform other than that of the first driving signal, in accordance with the level held in the flip flop, and a logic circuit for outputting the pulse signal, on the basis of the signal output from the selecting section and a control signal synchronized with the scanning signal and having a logic level opposite to that of the scanning signal.

The invention also can provide an electronic apparatus mounted with the electro-optical device having the construction according to the first invention described above.

The invention can further include a method of driving an electro-optical device having a plurality of pixels correspondingly provided to intersections of scanning lines and data lines, each of the plurality of pixels having a capacitor to which data writing is performed, a driving transistor for setting a driving current in accordance with the data written to the capacitor, and an electro-optical element for emitting light with a brightness corresponding to the set driving current, wherein a drive mode of each of the plurality of pixels constituting a display unit is selected. The driving method can include a first step of, when a first drive mode is selected as the drive mode, driving the electro-optical element for a first light emitting time period shorter than a time period from a time point at which a scanning line corresponding to the pixel in which data should be written is selected to a time point at which the scanning line is next selected, and a second step of, when a second drive mode other than the first drive mode is selected as the drive mode, driving the electro-optical element for a second light emitting time period longer than the first light emitting time period in the time period from a time point at which the scanning line corresponding to the pixel in which data should be written is selected to a time point at which the scanning line is next selected.

In the invention, in the first step, the electro-optical element may be impulse-driven, and in the second step, the electro-optical element may be hold-driven.

Further, in the invention, each of the pixels may further have a control transistor provided in a current path of the driving current to be supplied to the electro-optical element. In this case, it is preferable that in the first step, the electro-optical element be impulse-driven by repeatedly cutting off the current path of the driving current using the control transistor in the time period from a time point at which the scanning line corresponding to the pixel in which data should be written is selected to a time point at which the scanning line is next selected. Furthermore, it is preferable that in the second step, the electro-optical element be hold-driven by holding the current path of the driving current using the control transistor in the time period from a time point at which the scanning line corresponding to the pixel in which data should be written is selected to a time point at which the scanning line is next selected.

In the first step of the above invention, the electro-optical element may be impulse-driven by supplying the driving current to the electro-optical element in accordance with the data written to the capacitor and then erasing the data written to the capacitor, in the time period from a time point at which the scanning line corresponding to the pixel in which data should be written is selected to a time point at which the scanning line is next selected. In this case, in the second step, the electro-optical element may be hold-driven by continuously supplying the driving current to the electro-optical element in accordance with the data written to the capacitor in the time period from a time point at which the scanning line corresponding to the pixel in which data should be written is selected to a time point at which the scanning line is next selected.

Furthermore, the above invention may provide a method of driving an electro-optical device in which each of the pixels further has a programming transistor. In this case, data may be supplied as a data current to each of the pixels, and the data writing to the capacitor may be carried out on the basis of a gate voltage generated due to the data current flowing in a channel of the programming transistor.

Furthermore, the above invention may provide a method of driving an electro-optical device in which data is supplied as a data voltage to each of the pixels. In this case, the data writing to the capacitor may be carried out on the basis of the data voltage.

The invention can further provide an electro-optical device including a plurality of scanning lines; a plurality of data lines; a plurality of pixels correspondingly provided to intersections of the scanning lines and the data lines, a scanning line driving circuit for selecting the scanning line corresponding to the pixel in which data should be written, by outputting a scanning signal to the scanning lines, a data line driving circuit for cooperating with the scanning line driving circuit to output data to the data line corresponding to the pixel in which data should be written, and a drive mode selecting circuit for selecting a drive mode of each of the plurality of pixels. Here, each of the plurality of pixels has storing means for storing data, a driving element for setting a driving current in accordance with the data stored in the storing means, and an electro-optical element for emitting light with a brightness corresponding to the set driving current. When a first drive mode is selected as the drive mode, the drive mode selecting circuit drives the electro-optical element for a first light emitting time period shorter than a time period from a time point at which the scanning line corresponding to the pixel in which data should be written is selected to a time point at which the scanning line is next selected. Further, when a second drive mode other than the first drive mode is selected as the drive mode, the drive mode selecting circuit drives the electro-optical element for a second light emitting time period longer than the first light emitting time period in the time period from a time point at which the scanning line corresponding to the pixel in which data should be written is selected to a time point at which the scanning line is next selected.

The invention can also provide a method of driving an electro-optical device having a plurality of pixels correspondingly provided to intersections of scanning lines and data lines, each of the plurality of pixels having storing means for storing data, a driving element for setting a driving current in accordance with the data stored in the storing means, and an electro-optical element for emitting light with a brightness corresponding to the set driving current, wherein a drive mode of each of the plurality of pixels is selected. The driving method can include a first step of, when a first drive mode is selected as the drive mode, driving the electro-optical element for a first light emitting time period shorter than a time period from a time point at which a scanning line corresponding to the pixel in which data should be written is selected to a time point at which the scanning line is next selected, and a second step of, when a second drive mode other than the first drive mode is selected as the drive mode, driving the electro-optical element for a second light emitting time period longer than the first light emitting time period in the time period from a time point at which the scanning line corresponding to the pixel in which data should be written is selected to a time point at which the scanning line is next selected.

According to the present invention, in the electro-optical device employing an electro-optical element emitting light with a brightness corresponding to a driving current, different drive modes can be selected in a unit of scanning line depending upon targets to be displayed. As a result, since drive modes suitable for characteristics of the targets to be displayed can be applied, it is possible to accomplish improvement of the overall display quality.

BRIEF DESCRIPTION OF THE DRAWINGS

The invention will be described with reference to the accompanying drawing, wherein like numerals reference like elements, and wherein.

DETAILED DESCRIPTION OF PREFERRED EMBODIMENTS

This embodiment is directed to an electro-optical device employing a current programming method. Specifically, the embodiment is directed to a display control of an active matrix type display in which each pixel has a current mirror circuit. Here, the current programming method means that a data supply to a data line is performed on the basis of a current.

Figure 1:
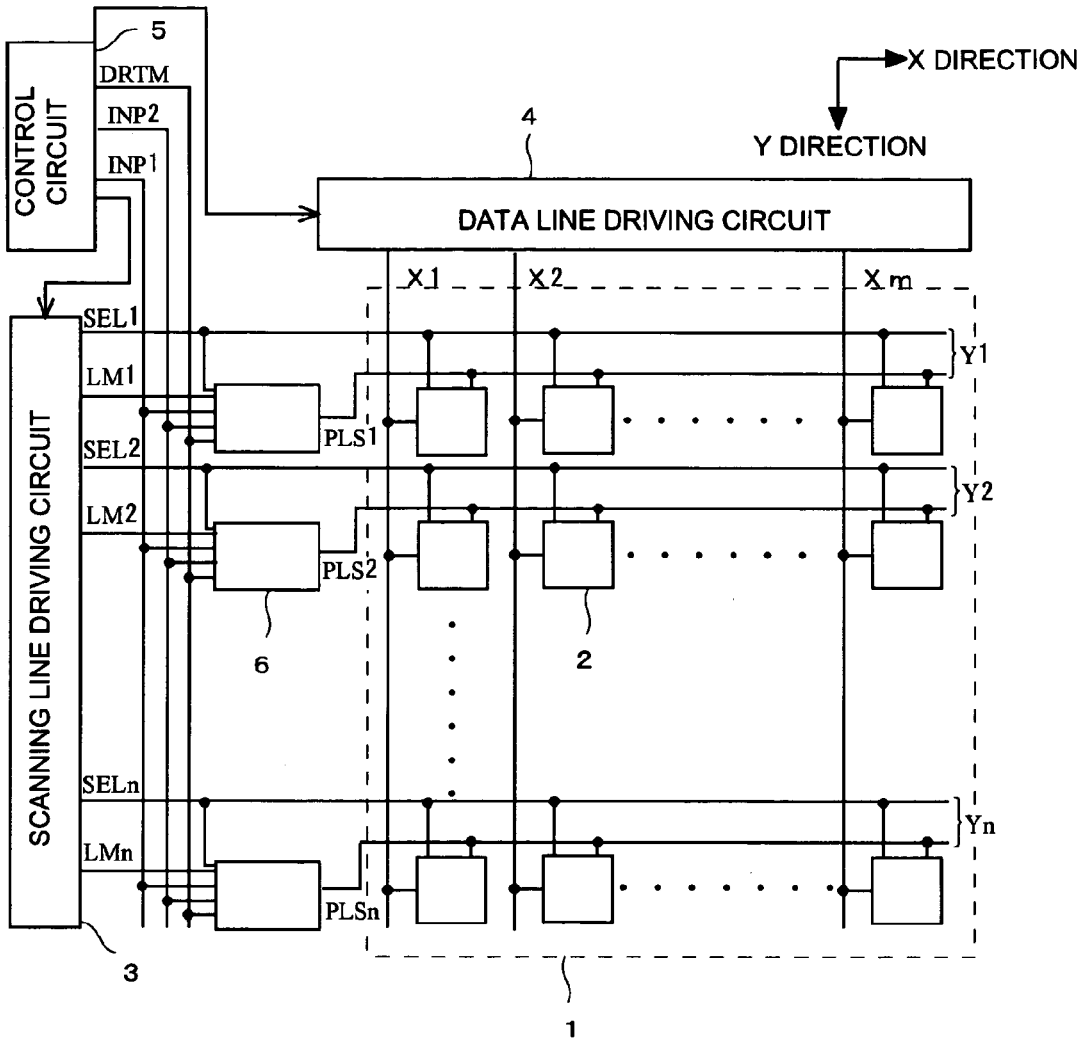
FIG. 1 is a block constructional view of an electro-optical device according to a first embodiment.

FIG. 1 is an exemplary block diagram of an electro-optical device. In a display unit 1, pixels 2 of m dots×n lines are arranged in a matrix shape (in a two-dimensional plane), and a group of horizontal lines Y1 to Yn extending in a horizontal direction and a group of data lines X1 to Xm extending in a vertical direction are arranged. One horizontal line Y (Y indicates any one of Y1 to Yn) has one scanning line and one signal line, and a scanning signal SEL and a pulse signal PLS are output thereto, respectively. The pixels 2 are arranged corresponding to intersections of the group of horizontal lines Y1 to Yn and the group of data lines X1 to Xm. The pulse signal PLS is a signal for controlling the driving of an electro-optical element constituting one pixel 2, in a time period (one vertical scanning period in this embodiment) from a time point at which the pixel 2 is selected to a time point at which the pixel 2 is next selected. Further, in this embodiment, one pixel 2 is used as a minimum display unit of image, but one pixel 2 may have a plurality of sub-pixels. Furthermore, in FIG. 1, power source lines for supplying predetermined fixed potentials Vdd, Vss to the pixels 2 are omitted.

A control circuit 5 controls synchronously a scanning line driving circuit 3 and a data line driving circuit 4 on the basis of a vertical synchronizing signal Vs, a horizontal synchronizing signal Hs, a dot clock signal DCLK and gradation data D, etc. to be input from a high-ranked device not shown. Under this synchronous control, the scanning line driving circuit 3 and the data line driving circuit 4 cooperate each other to perform a display control of the display unit 1.

The scanning line driving circuit 3 can include a shift register, an output circuit, etc. as main bodies, and sequentially selects the scanning lines by outputting the scanning signal SEL to the scanning lines. Using this sequential line scanning, a pixel row corresponding to a pixel group on one horizontal line is sequentially selected in a predetermined scanning direction (generally from uppermost to lowermost) in one vertical scanning period. Further, the scanning line driving circuit 3 also outputs a control signal LM to each horizontal line, in addition to the scanning signal SEL.

The control signal LM is a signal synchronized with the scanning signal SEL, and the scanning signal SEL and the control signal LM have logic levels opposite to each other. However, the variation timing of the control signal LM may be slightly deviated from the variation timing of the scanning signal SEL.

On the other hand, the data line driving circuit 4 can include a shift register, a line latch circuit, an output circuit, etc. as main bodies. In this embodiment, the data line driving circuit 4 includes a variable current source for converting data (data voltage Vdata) corresponding to a display gradation of the pixels 2 into a data current Idata, since the current programming method is employed. The data line driving circuit 4 concurrently performs the simultaneous output of the data current Idata to the pixel row to which data should be written at this time and the sequential latch of data associated with the pixel row to which the data should be written in a next horizontal scanning period, in one horizontal scanning period. In arbitrary horizontal scanning period, m pieces of data corresponding to the number of the data lines X are sequentially latched. Then, in the next horizontal scanning period, the m pieces of data latched are converted into the data current Idata, and then simultaneously output to the respective data lines X1 to Xm. The present invention may be applied to a construction in which data is line-sequentially input directly to the data line driving circuit 4 from a frame memory (not shown), but in this case, since operation of parts to which the present invention pays attention is similar thereto, description thereof will be omitted. In this case, the data line driving circuit 4 is not required to include the shift register.

The control circuit 5 outputs two kinds of driving signals INP1, INP2 and a drive mode signal DRTM to the drive mode selecting circuit 6. Here, a first driving signal INP1 is a pulse-shaped signal in which a high level (hereinafter, referred to as 'H level') and a low level (hereinafter, referred to as 'L level') are alternately repeated. Further, a second driving signal INP2 is a signal having a waveform different from the first driving signal INP1, and a duty ratio of a H level (a ratio of a H level time occupying a unit time) is larger than that of the first driving signal INP1. In this embodiment, a hold signal (normally-H level signal) having a duty ratio of 100% is used as the second driving signal INP2. However, this is only an example, and the duty ratio is not 100% necessarily as described in greater detail below.

Figure 2:
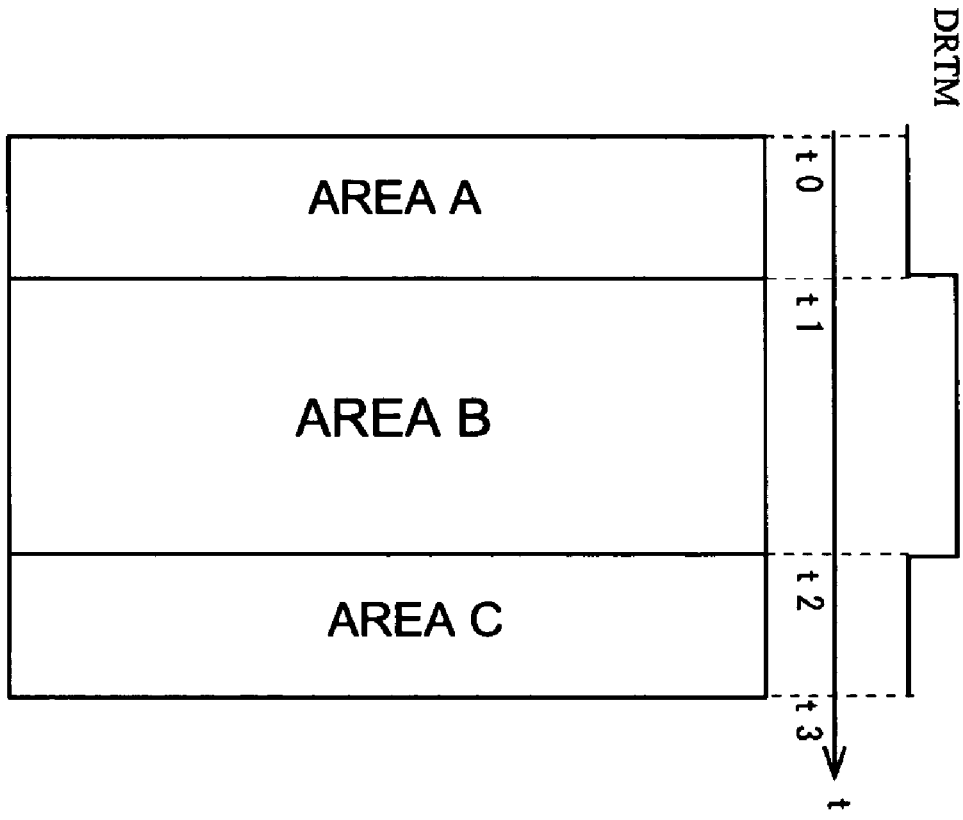
FIG. 2 is an explanatory view of a drive mode signal DRTM.

The drive mode selecting circuit 6 specifies drive modes of the pixels 2 constituting the display unit 1 in a unit of scanning line, that is, in a unit of a pixel row (pixel group on one horizontal line). Specifically, the drive mode selecting circuit 6 outputs the pulse signal PLS of controlling the driving of the electro-optical elements in a unit of scanning line, on the basis of the drive mode signal DRTM of specifying the drive mode in a unit of scanning line. FIG. 2 is an explanatory diagram of the drive mode signal DRTM. The drive mode signal DRTM is synchronized with the line-sequential scanning of the scanning line driving circuit 3, and an L level thereof specifies the hold driving and a H level thereof specifies the impulse driving. As an example, a case where a moving picture is displayed in a display area B and texts are displayed in display areas A, C above and below the area is considered. In the time period t0 to t1 when the scanning line groups constituting the display area A are sequentially selected, the drive mode signal DRTM is L level. Therefore, in the display area A, the hold driving suitable for display of a text is performed. Next, in the time period t1 to t2 when the scanning line groups constituting the display area B are sequentially selected, the drive mode signal DRTM becomes H level. Therefore, in the display area B, the impulse driving suitable for display of a moving picture is performed. Then, in the time period t2 to t3 when the scanning line groups constituting the display area C are sequentially selected, the drive mode signal DRTM becomes L level again. Therefore, in the display area C, the hold driving suitable for display of a text is performed.

Further, as another example, a case where the display unit 1 having an arbitrary resolution (for example, 1280×1024) displays a moving picture having a resolution (for example, 1024×768) smaller than the resolution in equimultiples is considered. In this case, similarly to the aforementioned case, it is also preferable that the impulse driving be performed in the display area B, and the hold driving be performed in the display areas A, C. Therefore, the drive mode signal DRTM becomes H level in the time period t1 to t2 when the scanning line groups constituting the display area B are sequentially selected, and becomes L level in the time period t0 to t1, t2 to t3 other than the time period.

Furthermore, the drive mode signal DRTM is generated on the basis of the signal from a high-ranked device of the control circuit 5. For example, discrimination between a moving picture and a still picture, or specification of a display resolution, etc. is instructed from an external CPU, etc. The control circuit 5 generates the drive mode signal DRTM on the basis of the instructions.

Figure 3:
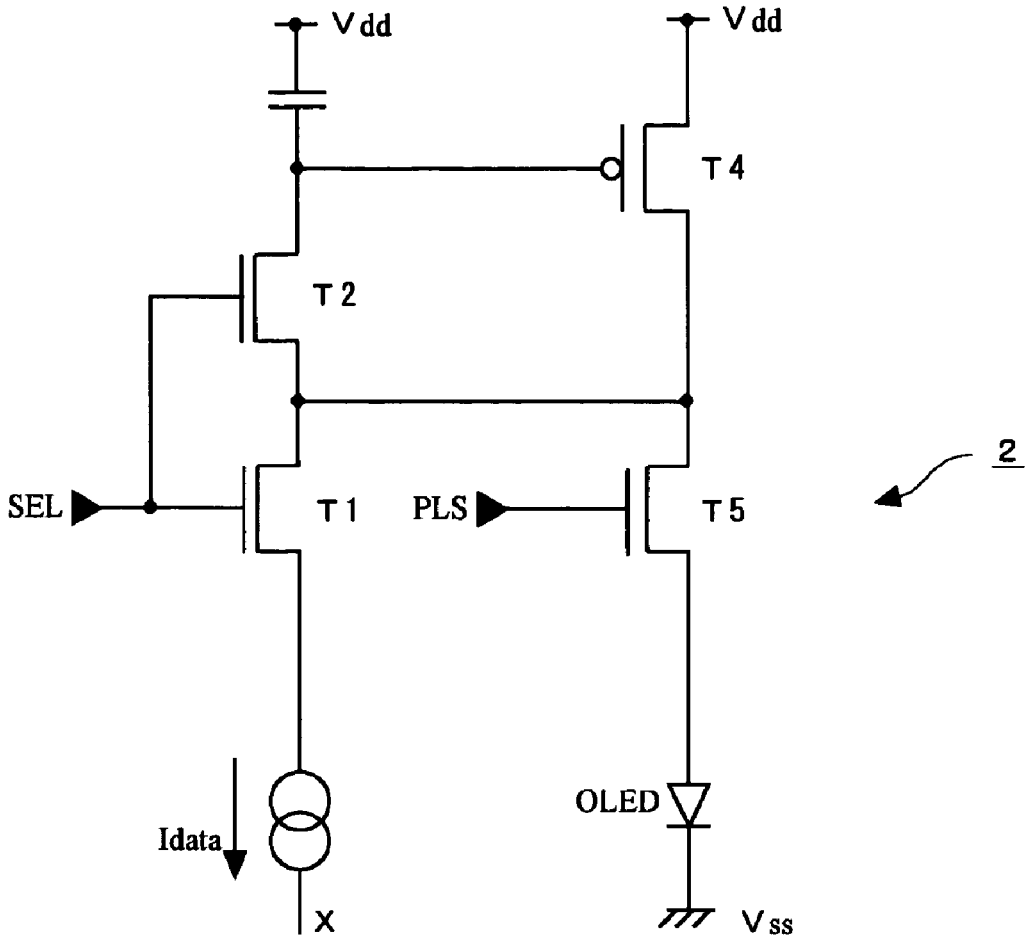
FIG. 3 is a circuit diagram of a pixel according to the first embodiment.

FIG. 3 is a circuit diagram of the pixel 2 according to this embodiment. One pixel 2 comprises an organic EL element OLED, four transistors T1, T2, T4, T5, and a capacitor C for storing data. Further, in the pixel circuit according to this embodiment, n channel transistors T1, T2, T5 and a p channel transistor T4 are used, but this is only one example and the present invention is not limited to this example.

A gate of a first switching transistor T1 is connected to the scanning line to be supplied with the scanning signal SEL, and a source thereof is connected to the data line X (X indicates any one of X1 to Xm) to be supplied with the data current Idata. A drain of the first switching transistor T1 is connected in common to a source of a second switching transistor T2, a drain of the driving transistor T4 which is one type of driving element, and a drain of a control transistor T5 which is one type of control element. A gate of the second switching transistor T2 is connected to the scanning line to be supplied with the scanning signal SEL, similarly to the first switching transistor T1.

A drain of the second switching transistor T2 is connected in common to one electrode of the capacitor C and a gate of the driving transistor T4. A power source potential Vdd is applied to the other electrode of the capacitor C and a source of the driving transistor T4. The control transistor T5 the gate of which is supplied with the pulse signal PLS is provided between a drain of the driving transistor T4 and an anode (positive electrode) of the organic EL element OLED. A potential Vss is applied to a cathode (negative electrode) of the organic EL element OLED.

Figure 4:
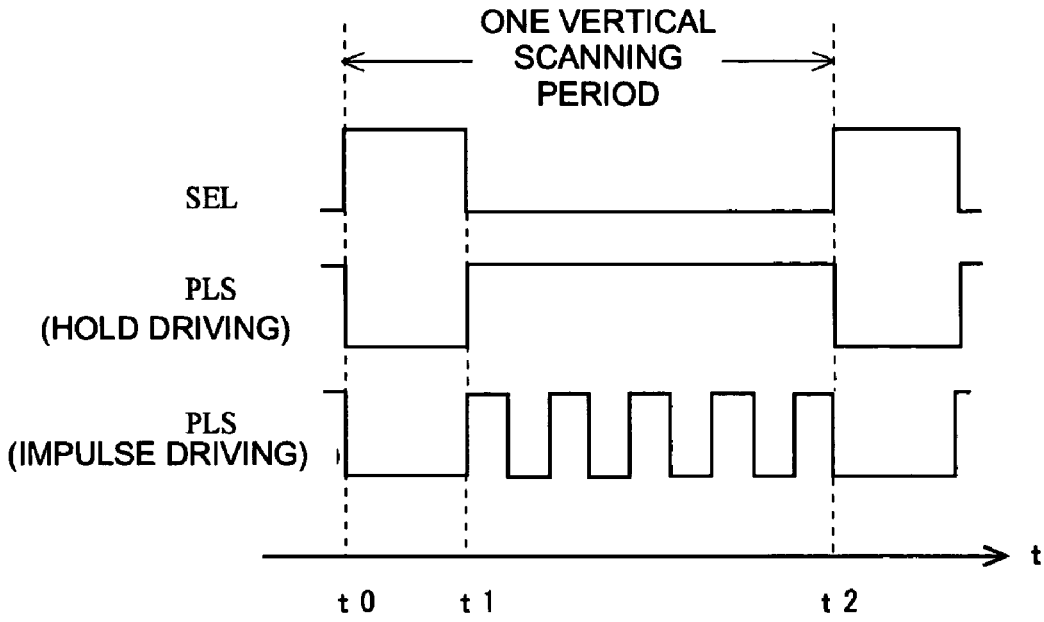
FIG. 4 is a timing chart for driving a pixel according to the first embodiment.

FIG. 4 is a timing chart for driving the pixel 2 according to this embodiment. A timing when selection of any pixel 2 is started through the line-sequential scanning of the scanning line driving circuit 3 is indicated by t0, and a timing when selection of the pixel 2 is next started is indicated by t2. The one vertical scanning period t0 to t2 is divided into a former programming period t0 to t1, and a latter driving period t1 to t2.

First, in the programming period t0 to t1, through the selection of the pixel 2 by means of the line-sequential scanning, data writing to the capacitor C is performed. At the timing t0, the scanning signal SEL rises to H level, and the switching transistors T1, T2 are all turned on. As a result, the data line X and the drain of the driving transistor T4 are electrically connected each other, and the driving transistor T4 forms a diode connection in which its own gate and its own drain are electrically connected each other. Accordingly, the driving transistor T4 allows the data current Idata supplied from the data line X to flow in its channel, thereby generating a gate voltage Vg corresponding to the data current Idata in its own gate. Charge corresponding to the generated gate voltage Vg is accumulated in the capacitor C connected to the gate of the driving transistor T4, thereby writing data thereto. In this way, in the programming period t0 to t1, the driving transistor T4 serves as a programming transistor for writing data to the capacitor C.

In the programming period t0 to t1, since the pulse signal PLS is kept in L level regardless of whether the pixel 2 is driven using either the hold driving or the impulse driving, the control transistor T5 is kept in the off state. Therefore, since a current path of a driving current Ioled to the organic EL element OLED is kept cut off, the organic EL element OLED does not emit light in the period t0 to t1.

Next, in the driving period t1 to t2, the driving current Ioled corresponding to the charge accumulated in the capacitor C flows in the organic EL element OLED, and in accordance with the drive mode, the organic EL element OLED emits light. First, at a driving start timing t1, the scanning signal SEL drops to L level, and the switching transistors T1, T2 are all turned off. As a result, the data line X supplied with the data current Idata and the drain of the driving transistor T4 are electrically separated from each other, and the gate and the drain of the driving transistor T4 are electrically separated. The gate voltage Vg is applied to the gate of the driving transistor T4, in accordance with the charge accumulated in the capacitor C.

In synchronization with drop of the scanning signal SEL at the timing t1, the waveform of the pulse signal PLS which was previously in L level turns to any one of a pulse shape and a hold shape, in accordance with the drive mode of the pixel 2. When the impulse driving is instructed by the aforementioned drive mode signal DRTM (DRTM=H), the pulse signal PLS turns to a pulse waveform in which H level and L level are alternately repeated. This pulse waveform is continued till a timing t2 when next selection of the pixel 2 is started is reached. As a result, the control transistor T5 the on/off state of which is controlled by the pulse signal PLS is repeatedly turned on and off. When the control transistor T5 is turned on, the current path of the driving current Ioled from the power source potential Vdd to the potential Vss through the driving transistor T4, the control transistor T5 and the organic EL element OLED is formed. The driving current Ioled flowing in the organic EL element OLED corresponds to a channel current of the driving transistor T4 for setting the current value, and is controlled by means of the gate voltage Vg due to the charge accumulated in the capacitor C. The organic EL element OLED emits light with a brightness corresponding to the driving current Ioled. On the other hand, when the control transistor T5 is turned off, the current path of the driving current Ioled is forcibly cut off by the control transistor T5. Therefore, in a time period when the control transistor T5 is turned off, the light emitting of the organic EL element OLED is temporarily stopped, and a black color is displayed. In this manner, in the driving period t1 to t2 in the impulse driving, since the current path of the driving current Ioled is repeatedly cut off by means of the on/off control of the control transistor T5, the light emitting and the light non-emitting of the organic EL element OLED are repeated (impulse driving). Further, the light emitting period of the organic EL element OLED in the impulse driving is determined by a duty ratio of the pulse signal PLS, that is, a duty ratio of the first driving signal INP1.

On the other hand, when the hold driving is instructed by the drive mode signal DRTM (DRTM=L), the pulse signal PLS turns to a hold shape to be normally H level. This state is continued until the timing t2 when the next selection of the pixel 2 is started is reached. As a result, since the control transistor T5 is normally turned on, the current path of the driving current Ioled from the power source potential Vdd to the potential Vss through the driving transistor T4, the control transistor T5 and the organic EL element OLED is formed, and this state is kept. Therefore, in the driving period t1 to t2 in the hold driving, since the control transistor T5 is normally turned on, the organic EL element OLED continuously emits light with the brightness corresponding to the driving current Ioled (hold driving). Further, the light emitting period of the organic EL element OLED in the hold driving is determined by the duty ratio of the pulse signal PLS, that is, the duty ratio of the second driving signal INP2. In this embodiment, the second driving signal INP2 is a hold signal. Therefore, the organic EL element OLED emits light for a time period (normally in this embodiment) longer than the light emitting period in the impulse driving.

Figure 5:
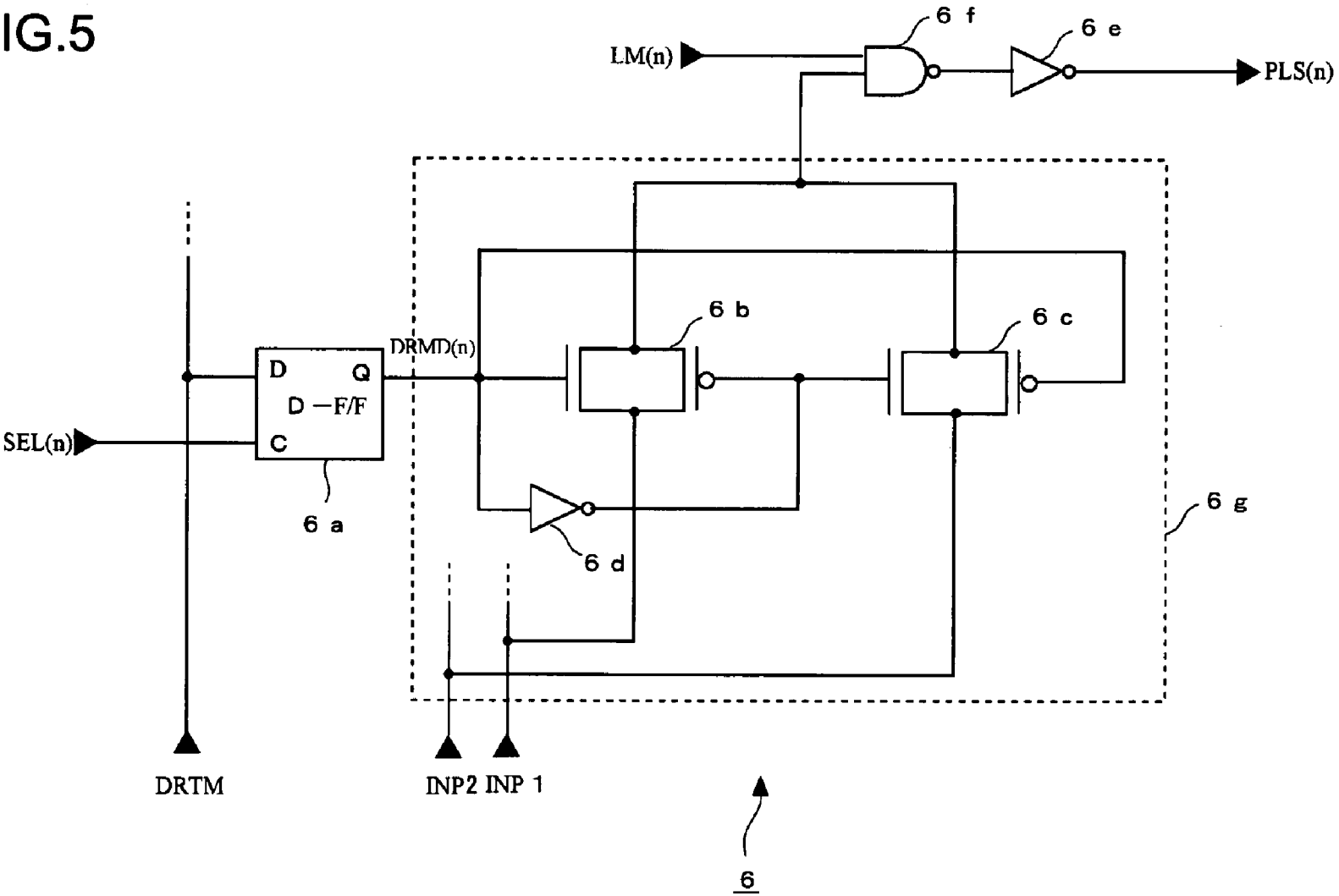
FIG. 5 is a circuit diagram of a drive mode selecting circuit.

The drive mode selecting circuits 6 can be provided corresponding to the horizontal lines (that is, in a unit of scanning line). The selecting circuits 6 generate and output the pulse signal PLS in a unit of the scanning line, on the basis of the signals DRTM, INP1, INP2 from the control circuit 5 and the signals SEL, LM from the scanning line driving circuit 3. FIG. 5 is an exemplary circuit diagram of the drive mode selecting circuit 6. The drive mode selecting circuit 6 can include a D flip flop 6*a* (D-FF), a pair of transmission gates 6*b*, 6*c*, two inverters 6*d*, 6*e*, and a NAND gate 6*f*.

A D input of the D flip flop 6*a* is connected to a signal line supplied with the drive mode signal DRTM, and a C input thereof is connected to the scanning line supplied with the scanning signal SEL(n). Here, the scanning signal SEL(n) is the scanning signal SEL output to the n-th scanning line (the meaning of (n) is true of signals to be described later). The D flip flop 6*a* memorizes a level of the drive mode signal DRTM of the D input at the rising timing of the scanning signal SEL(n) of the C input, and outputs the memorized level from Q output as a signal DRMD(n).

Furthermore, the Q output (the signal DRMD(n)) of the D flip flop 6*a* is output to a selecting section 6*g* comprising a pair of transmission gates 6*b*, 6*c* as main bodies. Specifically, the Q output is supplied to a gate of an n channel transistor constituting a part of the transmission gate 6*b* and a gate of a p channel transistor constituting a part of the transmission gate 6*c*. Furthermore, the Q output is level-inverted by means of the inverter 6*d*, and then is supplied to a gate of a p channel transistor of the transmission gate 6*b* and a gate of an n channel transistor of the transmission gate 6*c*. Furthermore, the first driving signal INP1 having the impulse shape is supplied to an input terminal of one transmission gate 6*b*, and the second driving signal INP2 having the hold shape is supplied to an input terminal of the other transmission gate 6*c*. When a gate signal of L level is applied to the p channel transistor and a gate signal of H level is applied to the n channel transistor, the pair of transmission gates 6*b*, 6*c* are turned on. Therefore, any one of the transmission gates 6*b*, 6*c* is alternatively turned on in accordance with the Q output level of the flip flop 6*a*, and any one of the driving signals INP1, INP2 is output from the transmission gates 6*b*, 6*c*.

The NAND gate 6*f* receives the output signal from the selecting section 6*g* and the control signal LM from the scanning line driving circuit 3, and computes an exclusive OR of both signals. Then, the computation result is level-inverted by means of the inverter 6*e*, and then is output to the corresponding pixel row as the pulse signal PLS(n).

Figure 6:
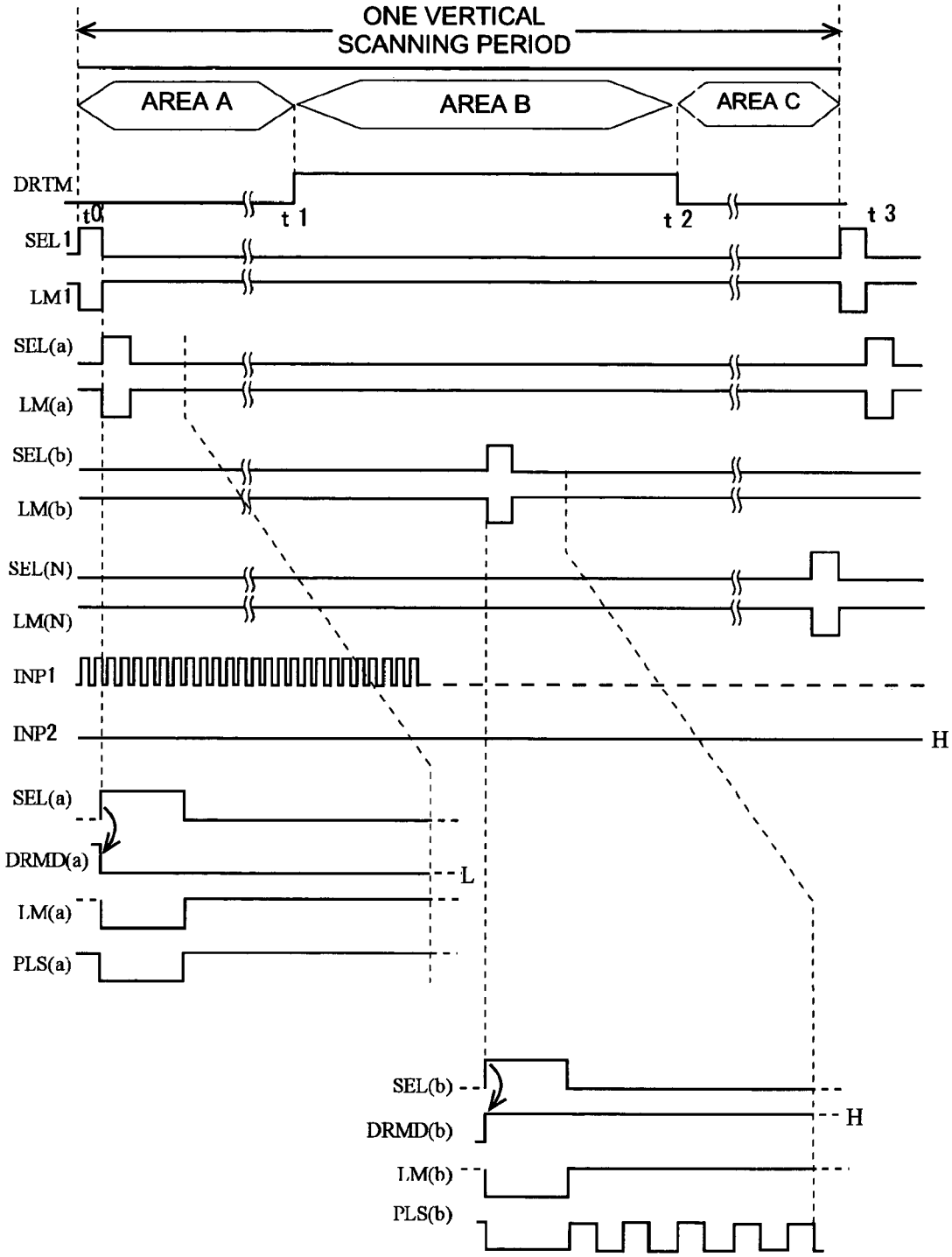
FIG. 6 is a timing chart of drive control by way of line-sequential scanning.

Next, referring to a timing chart shown in FIG. 6, the display control of the display unit 1 by means of the line sequential scanning will be described. This timing chart relates to a case where the hold driving is performed in the display area A, C and the impulse driving is performed in the display area B as shown in FIG. 2. The scanning line driving circuit 3 selects the scanning lines one by one, by sequentially converting the level of the scanning signal SEL into H level from the uppermost scanning line to the lowermost scanning line in one vertical scanning period t0 to t3.

First, any scanning line a positionally corresponding to the display area A in which the hold driving is performed will be described. In a time period when the scanning lines a included in the display area A are scanned line-sequentially, the drive mode signal DRTM is set to L level indicating the hold driving. At a start timing of selecting the scanning line a, the scanning line driving circuit 3 makes the scanning signal SEL(a) supplied to the scanning line a rise from L level to H level, and keeps the H level for one horizontal scanning period.

At the same time, the scanning line driving circuit 3 makes the control signal LM(a) drop from H level to L level in synchronization with the rising timing of the scanning signal SEL(a), and keeps the L level for one horizontal scanning period. The D flip flop 6*a* shown in FIG. 5 holds the level of the drive mode signal DRTM, that is, the L level at the variation timing (the rising timing in this embodiment) of the scanning signal SEL(a). As a result, the D flip-flop 6*a* outputs the L level as the output signal DRMD(a). When the output signal DRMD(a) is L level, the selecting section 6*g* at the latter stage selects the second driving signal INP2 having a hold shape, and outputs the second driving signal INP2 to the NAND gate 6*f* at the latter stage. The NAND gate 6*f* outputs H level while the control signal LM(a) having a logic level opposite to that of the scanning signal SEL(a) is L level, irregardless of the output from the selecting section 6*g*. Therefore, in this time period, the pulse signal PLS(a) which is an output from the inverter 6*e* becomes L level. The time period when the pulse signal PLS is L level corresponds to the programming period t0 to t1 described above (see FIG. 4). Thereafter, when the control signal LM(a) becomes H level, the NAND gate 6*f* outputs a logic level (L level) opposite to that of the second driving signal INP2 output from the selecting section 6*g*. Therefore, in the time period when the control signal LM(a) is H level, the same waveform as the second driving signal INP2, that is, a hold signal to be normally H level is output as the pulse signal PLS(a). The time period when the pulse signal PLS(a) is H level corresponds to the driving period t1 to t2 described above (see FIG. 4). In the driving period t1 to t2, since the control transistor T5 is normally turned on, the organic EL element OLED is hold-driven.

Next, any scanning line b positionally corresponding to the display area B in which the impulse driving is performed will be described. In a time period when the scanning lines b included in the display area B are scanned line-sequentially, the drive mode signal DRTM is set to H level indicating the impulse driving. At a start timing of selecting the scanning line b, the scanning line driving circuit 3 makes the scanning signal SEL(b) supplied to the scanning line b rise from L level to H level, and makes the control signal LM(b) drop from H level to L level in synchronization with it. In the drive mode selecting circuit 6 corresponding to the scanning line b, the D flip flop 6*a* holds the level of the drive mode signal DRTM, that is, the H level at the rising timing of the scanning signal SEL(b). As a result, the D flip flop 6*a* outputs the H level as the output signal DRMD(b). When the output signal DRMD(b) is H level, the selecting section 6*g* at the latter stage selects the first driving signal INP1 having an impulse shape, and outputs the first driving signal INP1 to the NAND gate 6*f* at the latter stage.

The NAND gate 6*f* outputs H level while the control signal LM(b) is L level, irregardless of the output from the selecting section 6*g*. Therefore, in the programming period t0 to t1, the pulse signal PLS(b) which is an output from the inverter 6*e* becomes L level. Thereafter, when the control signal LM(b) becomes H level, the NAND gate 6*f* outputs a pulse shaped signal having a logic level opposite to that of the first driving signal INP1 output from the selecting section 6*g*. Therefore, in the time period when the control signal LM(b) is H level, an impulse signal having the same waveform as the first driving signal lNP1, that is, a pulse shape is output as the pulse signal PLS(b). In the time period t1 to t2 when the pulse signal PLS(b) has the pulse shape, since the control transistor T5 is repeatedly turned on and off, the organic EL element OLED is impulse-driven.

Then, operation of any scanning line c positionally corresponding to the display area C in which the hold driving is performed is similar to the display area A described above, and as a result, the organic EL element OLED is hold-driven.

According to this embodiment, since the drive modes depending upon targets to be displayed in the display unit 1 can be selected in a unit of scanning line, it is possible to further accomplish improvement of the overall display quality of the display unit 1. That is, for the pixel 2 to be impulse-driven, the organic EL element OLED is driven in the first light emitting period shorter than the time period from a time point when a scanning line corresponding to the pixel 2 to which data should be written is selected to a time point when the scanning line is next selected. Further, for the pixel 2 to be hold-driven, the organic EL element OLED is driven in the second light emitting period longer than the first light emitting period, in the time period from a time point when a scanning line corresponding to the pixel 2 to which data should be written is selected to a time point when the scanning line is next selected.

As a result, for example, when a display target suitable for the hold driving is displayed in any display area A, C, the organic EL elements OLED in the horizontal line group included in the display area A, C emit light continuously. This is accomplished by normally turning on the control transistor T5 provided in the current path of the driving current Ioled in the time period (the driving period t1 to t2 thereof in this embodiment) from a time point when a pixel 2 is selected to a time point when the pixel is next selected. Further, when a display target suitable for the impulse driving is displayed in another display area B, the organic EL elements OLED in the horizontal line group included in the display area B emit light intermittently. This is accomplished by repeatedly turning on and off the control transistor T5 provided in the current path of the driving current Ioled in the driving period t1 to t2. Therefore, since the optical response of the pixel 2 can be allowed to approach an impulse type in the display region B and the time period (a time period of black display) when the organic EL element OLED does not emit light can be dispersed, it is possible to reduce flickers of the displayed image. In addition, by improving the optical response of the pixels 2, it is possible to effectively suppress generation of pseudo profiles in displaying the moving picture.

Furthermore, according to this embodiment, only by use of a scanning line driving system including both of the scanning line driving circuit 3 and the drive mode selecting circuit 6, it is possible to implement selection of the aforementioned drive modes. Therefore, it is possible to suppress increase of a circuit scale due to addition of the selection function.

Figure 7:
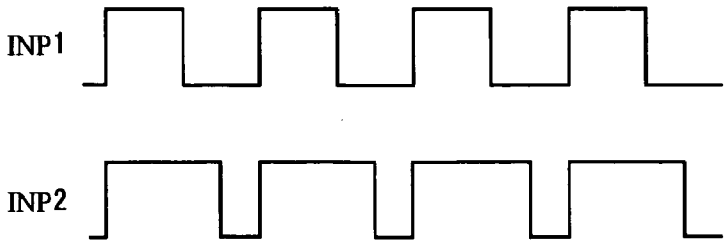
FIG. 7 is a view illustrating pulse waveforms of drive signals INP1, INP2.

Furthermore, in the aforementioned embodiment, an example where the first driving signal INP1 is the impulse signal and the second driving signal INP2 is the hold signal has been described. However, the second driving signal INP2 is not necessarily the hold signal, including embodiments to be described in greater detail below, and for example, as shown in FIG. 7, may be a pulse signal having a waveform (duty ratio) different from the first driving signal INP1. As a result, it is possible to change the waveform of the pulse signal PLS for controlling the driving of the organic EL element OLED. Accordingly, since the time-averaged display brightness can be set to be variable by the on/off control of the control transistor T5, it is possible to accomplish improvement of the overall display quality of the display unit 1. Furthermore, although an example of the waveform in which the switching of H and L is repeated many times in one frame has been described as the waveform of INP1 indicating the impulse driving, the waveform in which the switching of H and L in one frame occurs only one time may be employed, including the embodiments to be described later. In this case, since the electrical noise due to the signal driving can be reduced, improvement in reliability of a circuit can be obtained.

Furthermore, in the aforementioned embodiment, an example where three display areas A to C are set in the display unit 1 has been described. However, the present invention is not limited to this example, but may arbitrarily set the number and positions of divisions of the display area, or specification of the drive modes, using the drive mode signal DRTM.

This embodiment is directed to an electro-optical device employing the current programming method, and specifically to a pixel circuit employing a current mirror circuit. Further, the whole construction of the electro-optical device, including the embodiments to be described later, is basically similar to that of FIG. 1, except for the construction of one horizontal line Y. In this embodiment, one horizontal line Y comprises two scanning lines to be supplied with the scanning signals SEL1, SEL2, respectively, and one signal line to be supplied with the pulse signal PLS. Furthermore, the scanning signals SEL1, SEL2 have logic levels opposite to each other basically, but the variation timing of any one side may be slightly deviated.

Figure 8:
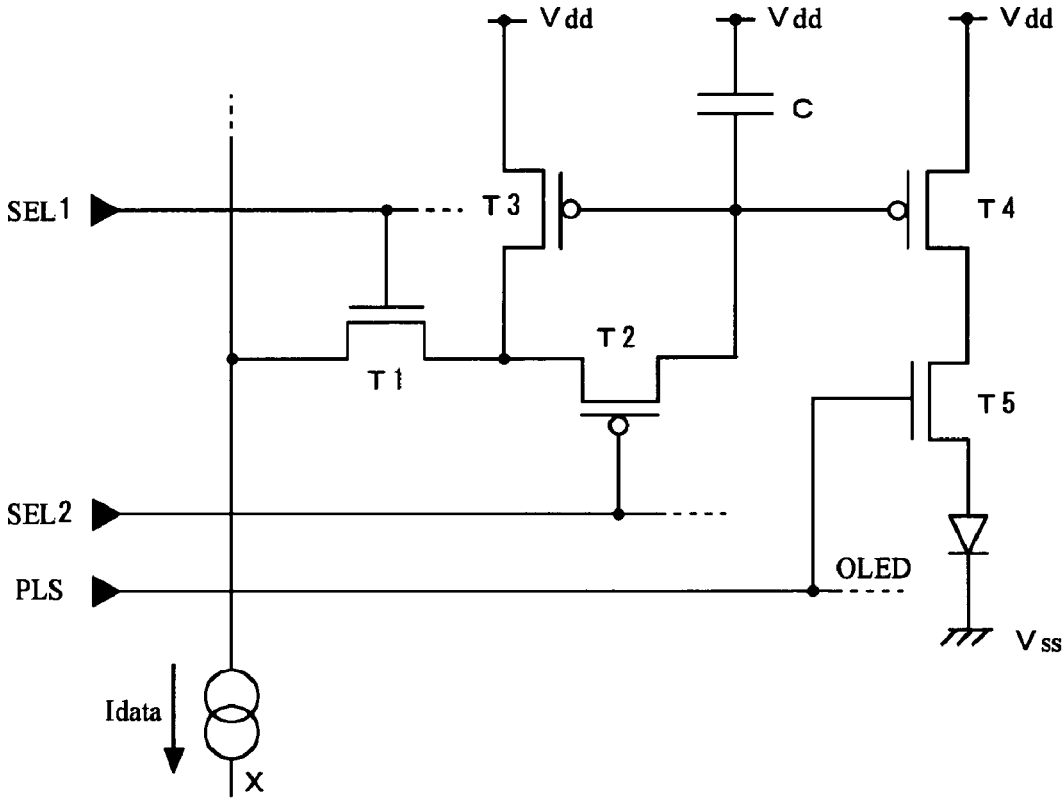
FIG. 8 is a circuit diagram of a pixel according to a second embodiment.

FIG. 8 is an exemplary circuit diagram of a pixel 2 according to this embodiment. One pixel 2 comprises an organic EL element OLED, five transistors T1 to T5 which are active elements, and a capacitor C. The organic EL element OLED shown as a diode is a current driven element the luminescent brightness of which is controlled corresponding to the driving current Ioled supplied to the element. Further, in this pixel circuit, the n channel transistors T1, T5 and the p channel transistors T2 to T4 are used, but this is only an example, and the present invention is not limited to this example.

A gate of the first switching transistor T1 is connected to the scanning line to be supplied with the first scanning signal SEL1, and a source thereof is connected to the data line X to be supplied with the data current Idata. Further, a drain of the first switching transistor T1 is connected in common to a drain of the second switching transistor T2 and a drain of the programming transistor T3. A source of the second switching transistor T2 a gate of which is supplied with the second scanning signal SEL2 is connected in common to gates of a pair of transistors T3, T4 constituting a current mirror circuit and one electrode of the capacitor C. The power source potential Vdd is applied to a source of the programming transistor T3, a source of the driving transistor T4 and the other electrode of the capacitor C. The control transistor T5 a gate of which is supplied with the pulse signal PLS is provided in the current path of the driving current Ioled, specifically, between a drain of the driving transistor T4 and the anode of the organic EL element OLED. The potential Vss lower than the power source potential Vdd is applied to the cathode of the organic EL element OLED. The programming transistor T3 and the driving transistor T4 constitute the current mirror circuit the gates of which are connected each other. Therefore, the current level of the data current Idata flowing in the channel of the programming transistor T3 is proportional to the current level of the driving current Ioled flowing in the channel of the driving transistor T4.

Figure 9:
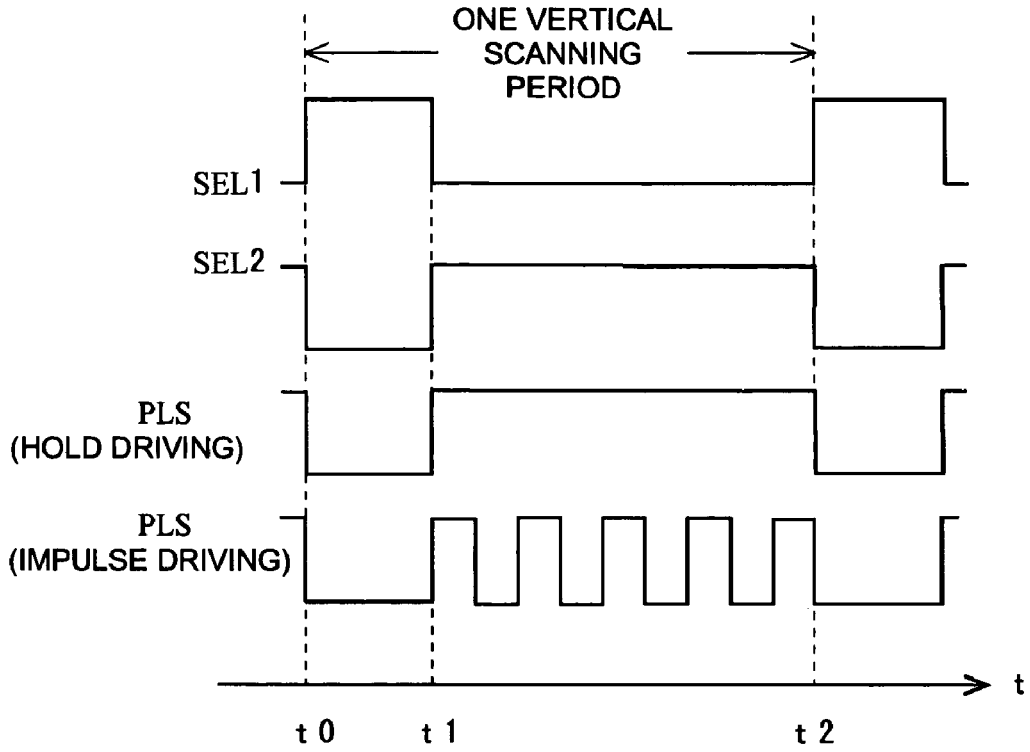
FIG. 9 is a timing chart for driving a pixel according to a second embodiment.

FIG. 9 is a timing chart for driving the pixel 2 according to this embodiment. Similarly to the aforementioned embodiment, one vertical scanning period t0 to t2 is divided into the programming period t0 to t1 and the driving period t1 to t2.

First, in the programming period t0 to t1, through the selection of the pixels 2, data writing to the capacitor C is performed. At the timing to, the first scanning signal SEL1 rises to H level, and the first switching transistor T1 is turned on. As a result, the data line X and the drain of the programming transistor T3 are electrically connected each other. In synchronization with the rising of the first scanning signal SEL1, the second scanning signal SEL2 drops to L level, and the second switching transistor T2 is turned on. As a result, the programming transistor T3 forms a diode connection in which its own gate is connected to its own drain to serve as a non-linear resistance element. Accordingly, the programming transistor T3 allows the data current Idata supplied from the data line X to flow in its channel, thereby generating a gate voltage Vg corresponding to the data current Idata in its own gate. Charge corresponding to the generated gate voltage Vg is accumulated in the capacitor C connected to the gate of the programming transistor T3, thereby writing data thereto.

In the programming period t0 to t1, since the pulse signal PLS is kept in L level, the control transistor T5 is kept in the off state. Therefore, since the current path to the organic EL element OLED is kept cut off, regardless of threshold values of the pair of transistors T3, T4 constituting the current mirror circuit. For this reason, in this time period t0 to t1, the organic EL element OLED does not emit light.

Next, in the driving period t1 to t2, the driving current Ioled corresponding to the charge accumulated in the capacitor C flows in the organic EL element OLED, and in accordance with the drive mode, the organic EL element OLED emits light. First, at a driving start timing t1, the first scanning signal SEL1 drops to L level, and the second scanning signal SEL2 rises to H level, so that the switching transistors T1, T2 are all turned off. As a result, the data line X supplied with the data current Idata and the drain of the driving transistor T4 are electrically separated from each other, and the gate and the drain of the driving transistor T4 are electrically separated. The gate voltage Vg is applied to the gate of the driving transistor T4, in accordance with the charge accumulated in the capacitor C.

In synchronization with the drop of the first scanning signal SEL1 at the timing t1, the waveform of the pulse signal PLS which was previously in L level turns to any one of a pulse shape and a hold shape, in accordance with the drive mode of the pixel 2. When the impulse driving is instructed by means of the aforementioned drive mode signal DRTM (DRTM=H), the pulse signal PLS turns to a pulse waveform. As a result, since the control transistor T5 provided in the current path of the driving current Ioled is repeatedly turned on and off in the driving period t1 to t2 in the impulse driving, the current path of the driving current Ioled is repeatedly cut off. Accordingly, the organic EL element OLED is impulse-driven. On the other hand, when the hold driving is instructed by means of the drive mode signal DRTM (DRTM=L), the pulse signal PLS turns to a hold shape to be normally H level. As a result, since the control transistor T5 is normally turned on in the driving period t1 to t2 in the hold driving, the current path of the driving current Ioled is held. Accordingly, the organic EL element OLED is hold-driven.

According to this embodiment, the drive modes depending upon targets to be displayed in the display unit 1 can be selected in a unit of scanning line. Therefore, similarly to the first embodiment, it is possible to further accomplish improvement of the overall display quality of the display unit 1, and also to suppress increase of the circuit scale due to addition of the selection function.

Furthermore, according to this embodiment, by providing the control transistor T5 in the current path of the driving current Ioled, it is possible to release restriction on the threshold values of the pair of transistors T3, T4 constituting the current mirror circuit. In the pixel circuit having the current mirror circuit disclosed in the aforementioned Patent Document 1, the control transistor T5 is not provided in the current path of the driving current Ioled. For this reason, the threshold value of the driving transistor T4 is required to be set not less than the threshold value of the programming transistor T3. This is because when this relationship is not set, the driving transistor T4 is turned on before the data writing to the capacitor C is completely finished, so that the organic EL element OLED emits light due to the leak current. Furthermore, since the driving transistor T4 cannot be completely turned off, there may occur a problem that the organic EL element OLED cannot be completely put out, that is, the black display cannot be performed.

On the contrary, as in this embodiment, when the control transistor T5 is further provided in the current path of the driving current Ioled and the control transistor is keep turned off in the programming period t0 to t1, the current path of the driving current Ioled can be forcibly cut off, irregardless of the threshold relation between the transistors T3, T4. As a result, since it is possible to surely prevent the organic EL element OLED from emitting light due to the leak current of the driving transistor T4 in the programming period t0 to t1, it is possible to further accomplish improvement of the display quality. Furthermore, in a case where the second switching transistor T2 is replaced with an n channel transistor and the scanning signal SEL1 is applied to the gate of T2, the same advantages can be also obtained. In this case, since the scanning line SEL1 is not required, the circuit scale forming a pixel is decreased, so that it is possible to contribute to improvement in yield or aperture ratio.

This embodiment is directed to a construction of a pixel circuit employing the current programming method, wherein the driving transistor also serves as the programming transistor. In this embodiment, one horizontal line Y comprises one scanning line to be supplied with the scanning signal SEL, and one signal line to be supplied with the pulse signal PLS.

Figure 10:
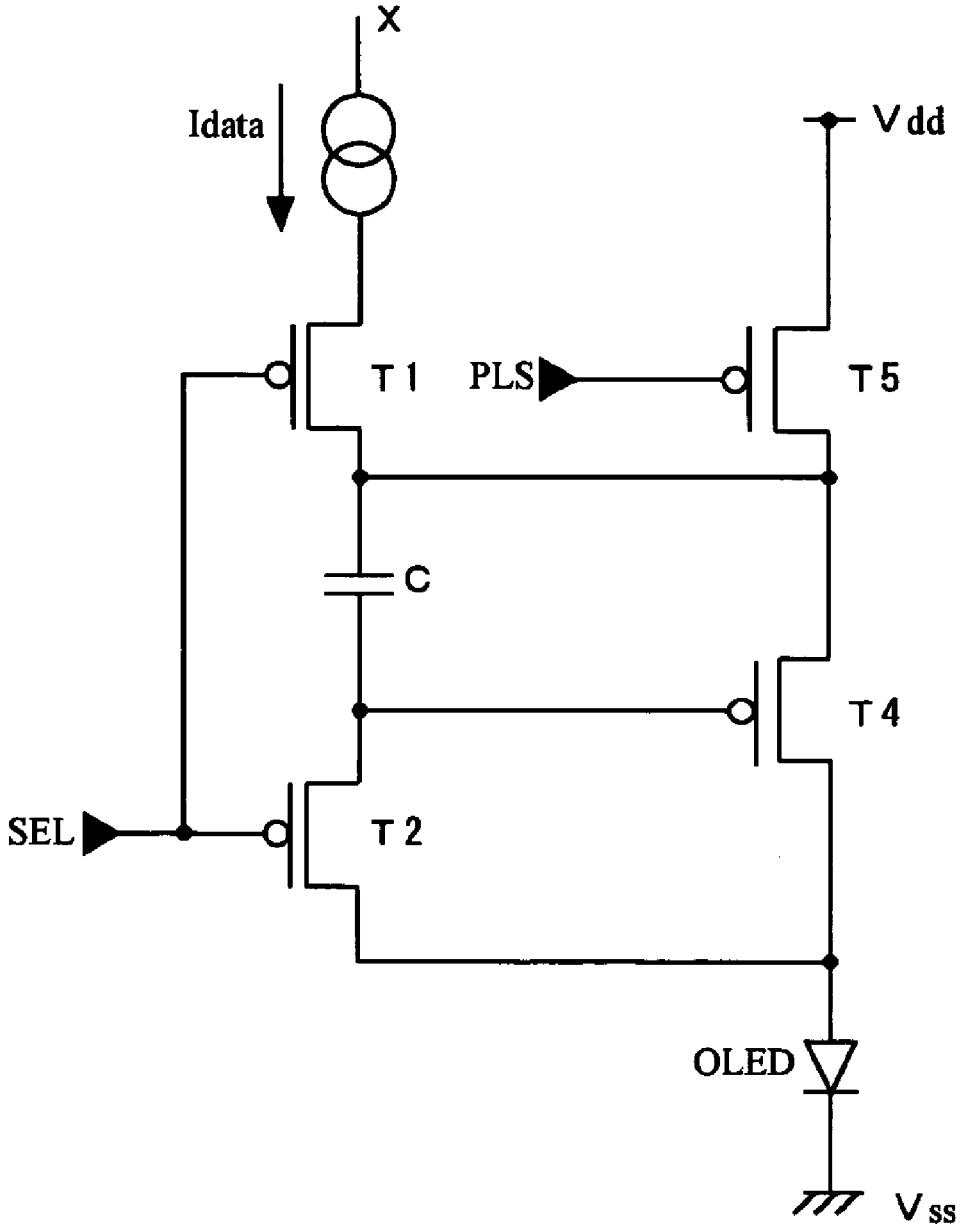
FIG. 10 is a circuit diagram of a pixel according to a third embodiment.

FIG. 10 is an exemplary circuit diagram of a pixel 2 according to this embodiment. One pixel 2 comprises an organic EL element OLED, four transistors T1, T2, T4, T5, and a capacitor C. On the other hand, in the pixel circuit according to this embodiment, types of the transistors T1, T2, T4, T5 are all p channel type, but this is only one example, and the present invention is not limited to this example.

A gate of the first switching transistor T1 is connected to the scanning line to be supplied with the scanning signal SEL, and a source thereof is connected to the data line X to be supplied with the data current Idata. A drain of the first switching transistor T1 is connected in common to a drain of the control transistor T5, a source of the driving transistor T4, and one electrode of the capacitor C. The other electrode of the capacitor C is connected in common to a gate of the driving transistor T4 and a source of the second switching transistor T2. A gate of the second switching transistor T2 is connected to the scanning line to be supplied with the scanning signal SEL, similarly to the first switching transistor T1. A drain of the second switching transistor T2 is connected in common to a drain of the driving transistor T4 and an anode of the organic EL element OLED. The potential Vss is applied to a cathode of the organic EL element OLED. A gate of the control transistor T5 is connected to the signal line to be supplied with the pulse signal PLS, and the power source potential Vdd is applied to its source.

Figure 11:
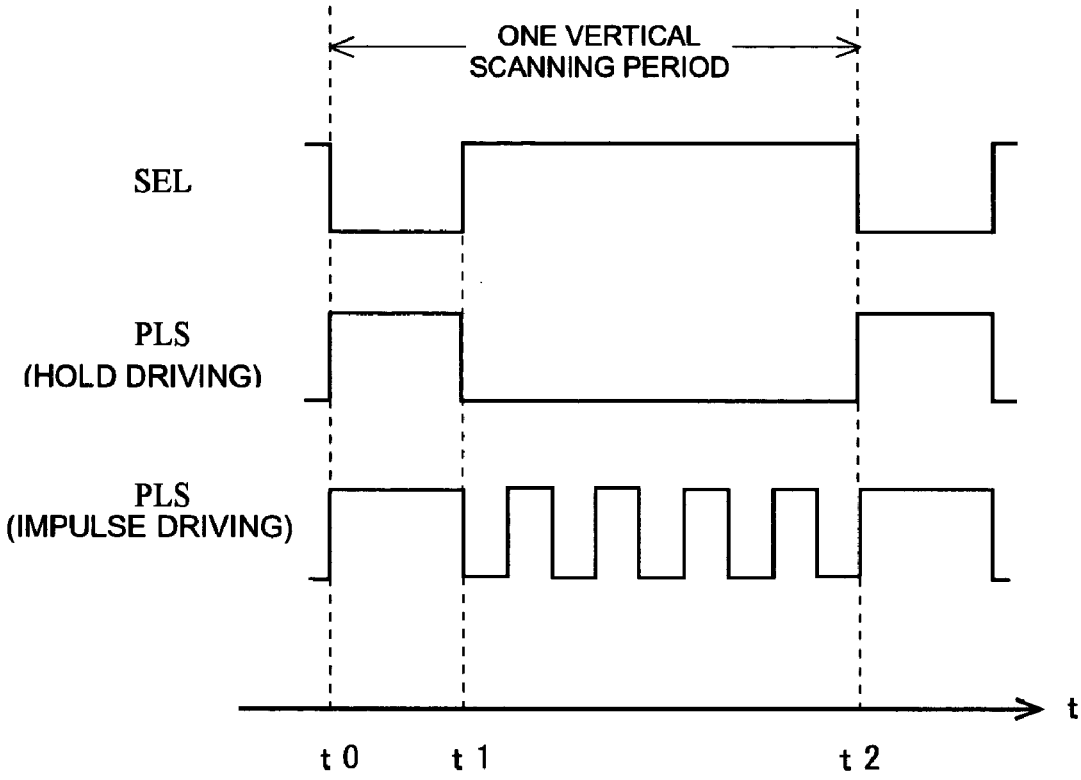
FIG. 11 is a timing chart for driving a pixel according to a third embodiment.

FIG. 11 is a timing chart for driving the pixel 2 according to this embodiment. Almost all over one vertical scanning period t0 to t2 in the pixel circuit of FIG. 10, since a current flows in the organic EL element OLED, the organic EL element OLED emits light. Similarly to the aforementioned embodiments, one vertical scanning period t0 to t2 is divided into the programming period t0 to t1 and the driving period t1 to t2.

First, in the programming period t0 to t1, through the selection of the pixel 2, data writing to the capacitor C is performed. At the timing t0, the scanning signal SEL drops to L level, and the switching transistors T1, T2 are all turned on. As a result, the data line X and the source of the driving transistor T4 are electrically connected each other, and the driving transistor T4 forms a diode connection in which its own gate and its own drain are electrically connected each other.

Accordingly, the driving transistor T4 allows the data current Idata supplied from the data line X to flow in its channel, thereby generating a gate voltage Vg corresponding to the data current Idata in its own gate. Charge corresponding to the generated gate voltage Vg is accumulated in the capacitor C connected between the gate and the source of the driving transistor T4, thereby writing data thereto. In this manner, in the programming period t0 to t1, the driving transistor T4 serves as a programming transistor for writing data to the capacitor C.

In the programming period t0 to t1, since the pulse signal PLS is kept in H level, the control transistor T5 is kept in the off state. Therefore, since the current path of the driving current Ioled from the power source potential Vdd to potential Vss is kept cut off. However, the current path of the data current Idata is formed between the data line X and the potential Vss through the first switching transistor T1, the driving transistor T4 and the organic EL element OLED. Therefore, also in the programming period t0 to t1, the organic EL element OLED emits light with a brightness corresponding to the data current Idata.

Next, in the driving period t1 to t2, the driving current Ioled corresponding to the charge accumulated in the capacitor C flows in the organic EL element OLED, and the organic EL element OLED thus emits light. First, at a driving start timing t1, the scanning signal SEL rises to H level, and the switching transistors T1, T2 are all turned off. As a result, the data line X supplied with the data current Idata and the source of the driving transistor T4 are electrically separated from each other, and the gate and the drain of the driving transistor T4 are electrically separated. The gate voltage Vg is applied to the gate of the driving transistor T4, in accordance with the charge accumulated in the capacitor C.

In synchronization with the rising of the scanning signal SEL at the timing t1, the waveform of the pulse signal PLS which was previously in H level turns to any one of a pulse shape and a hold shape (L level), in accordance with the drive mode of the pixel 2. When the impulse driving is instructed by the aforementioned drive mode signal DRTM (DRTM=H), the pulse signal PLS turns to a pulse waveform. As a result, since the control transistor T5 provided in the current path of the driving current Ioled is repeatedly turned on and off in the driving period t1 to t2 in the impulse driving, the organic EL element OLED is impulse-driven. On the other hand, when the hold driving is instructed by means of the drive mode signal DRTM (DRTM=L), the pulse signal PLS turns to a hold shape to be normally L level. As a result, since the control transistor T5 is normally turned on in the driving period t1 to t2 in the hold driving, the organic EL element OLED is hold-driven.

According to this embodiment, as described above, the drive modes depending upon targets to be displayed in the display unit 1 can be selected in a unit of scanning line. Therefore, similarly to the aforementioned embodiments, it is possible to further accomplish improvement of the overall display quality of the display unit 1, and also to suppress increase of the circuit scale due to addition of the selection function.

Figure 12:
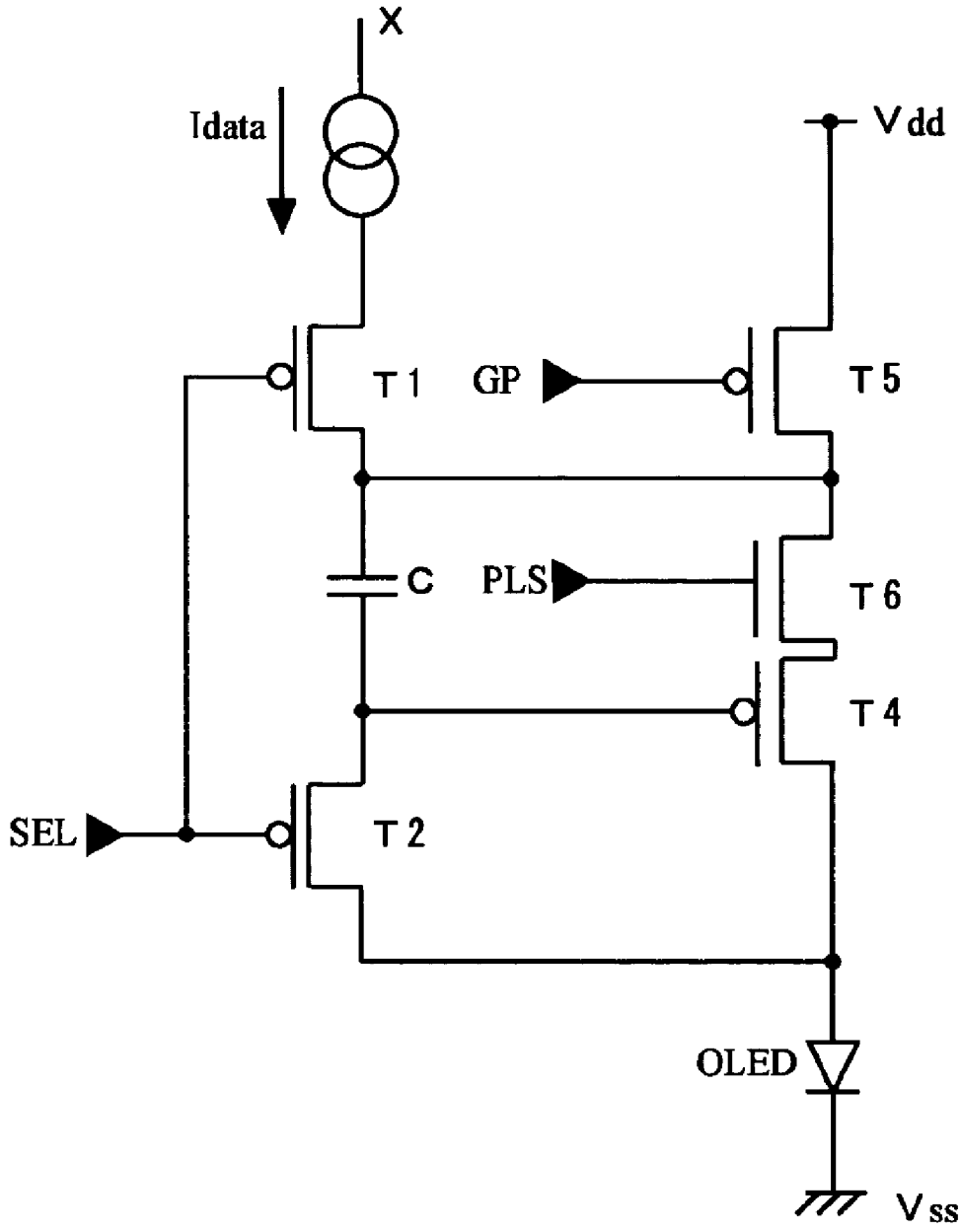
FIG. 12 is a modification of the circuit diagram of a pixel according to the third embodiment.
Figure 13:
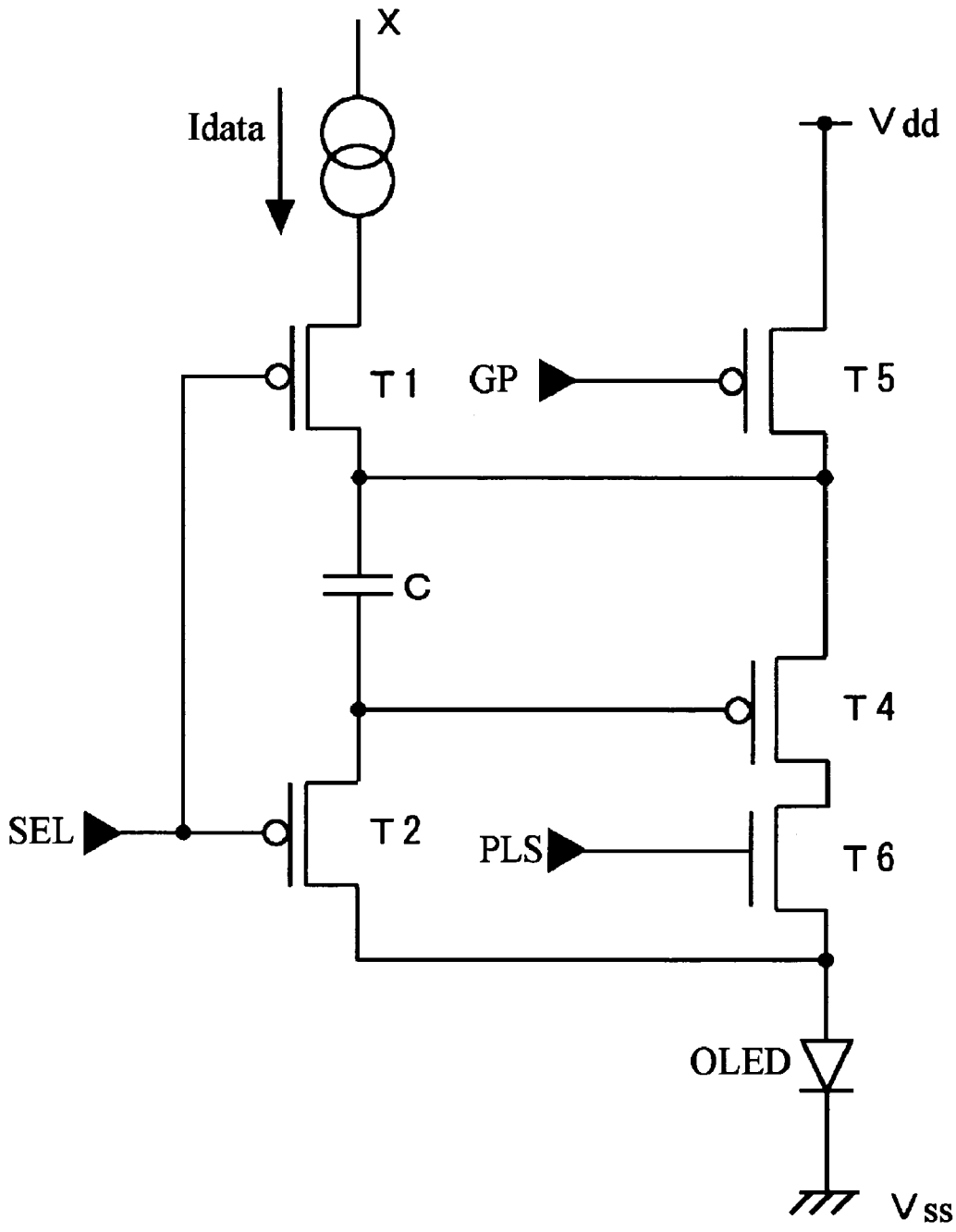
FIG. 13 is another modification of the circuit diagram of pixel according to the third embodiment.

Further, in this embodiment, the intermittent light emitting of the organic EL element OLED is performed through the on/off control of the control transistor T5 provided in the current path of the driving current Ioled. However, as shown in FIGS. 12 and 13, also in a case where a second control transistor T6 is added in the current path of the driving current Ioled, separately from the control transistor T5, the same advantages can be obtained. In the pixel circuit of FIG. 12, the second control transistor T6 is provided between the drain of the first control transistor T5 and the source of the driving transistor T4. Furthermore, in the pixel circuit of FIG. 13, the second control transistor T6 is provided between the drain of the driving transistor T4 and the anode of the organic EL element OLED. The second control transistor T6 is, for example, an n channel transistor, and its gate is supplied with the pulse signal PLS. On the other hand, the gate of the first control transistor T5 is supplied with the control signal GP.

Figure 14:
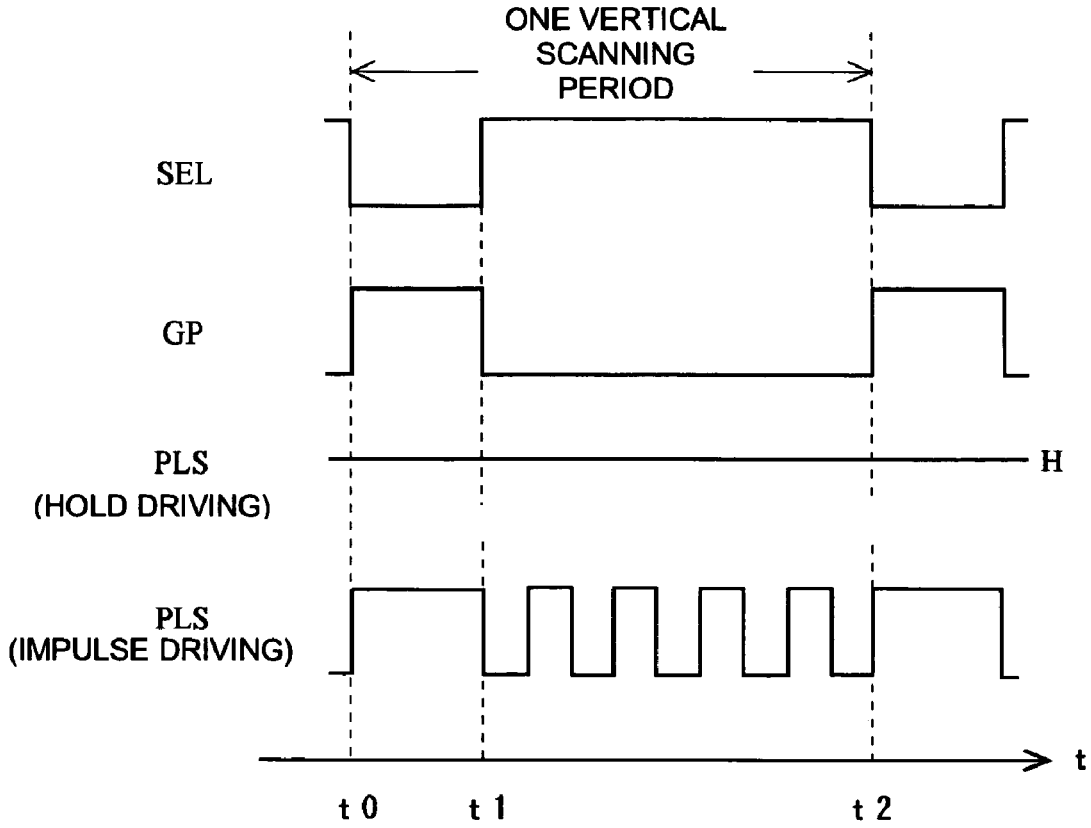
FIG. 14 is a timing chart for driving a pixel according to the third embodiment.

FIG. 14 is a timing chart for driving the pixel 2 of FIG. 12 or 13. The control signal GP is kept in H level in the programming period t0 to t1. Therefore, the current path of the driving current Ioled is cut off by means of the control transistor T5 the on/off state of which is controlled by the control signal GP. In the programming period t0 to t1, since the pulse signal PLS is H level, the second control transistor T6 is turned on. Therefore, since the current path of the data current Idata is formed, data is written to the capacitor C, and the organic EL element OLED emits light. In the subsequent driving period t1 to t2, when the impulse driving is instructed (DRTM=H), the pulse signal PLS turns to a pulse waveform. As a result, since the control transistor T5 provided in the current path of the driving current Ioled is repeatedly turned on and off in the driving period t1 to t2 in the impulse driving, the organic EL element OLED is impulse-driven. On the other hand, when the hold driving is instructed by means of the drive mode signal DRTM (DRTM=L), the pulse signal PLS turns to a hold shape to be normally H level. As a result, since the control transistor T5 is normally turned on in the driving period t1 to t2 in the hold driving, the organic EL element OLED is hold-driven.

This embodiment is directed to a construction of a pixel circuit employing the voltage programming method, and specifically to a so-called CC (Conductance Control) method. Here, the 'voltage programming method' means that a data supply to a data line X is performed on the basis of a voltage. In this embodiment, one horizontal line Y comprises one scanning line to be supplied with the scanning signal SEL and one signal line to be supplied with the pulse signal PLS. In the voltage programming method, since the data voltage Vdata is output to the data line X as it is, it is not necessary to provide a variable current source in the data line driving circuit 4.

Figure 15:
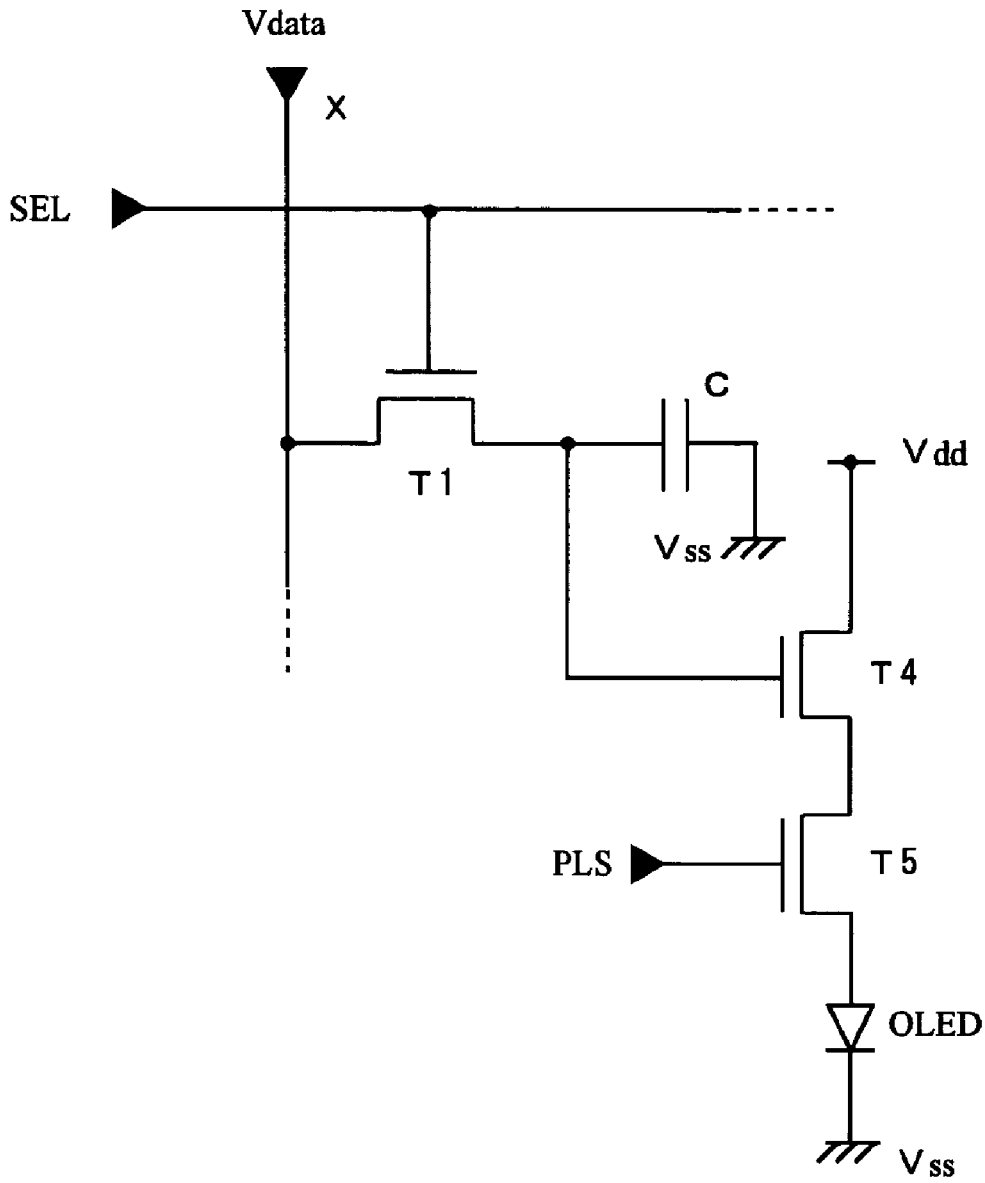
FIG. 15 is a circuit diagram of a pixel according to a fourth embodiment.

FIG. 15 is an exemplary circuit diagram of a pixel 2 according to this embodiment. One pixel 2 comprises an organic EL element OLED, three transistors T1, T4, T5, and a capacitor C. On the other hand, in the pixel circuit according to this embodiment, types of the transistors T1, T4, T5 are all n channel type, but this is only one example, and the present invention is not limited to this example.

A gate of the switching transistor T1 is connected to the scanning line to be supplied with the scanning signal SEL, and its drain is connected to the data line X to be supplied with the data voltage Vdata. A source of the switching transistor T1 is connected in common to one electrode of the capacitor C and a gate of the driving transistor T4. The potential Vss is applied to the other electrode of the capacitor C, and the power source potential Vdd is applied to a drain of the driving transistor T4. The on/off state of the control transistor T5 is controlled by the pulse signal PLS, and its source is connected to the anode of the organic EL element OLED. The potential Vss is applied to the cathode of the organic EL element OLED.

Figure 16:
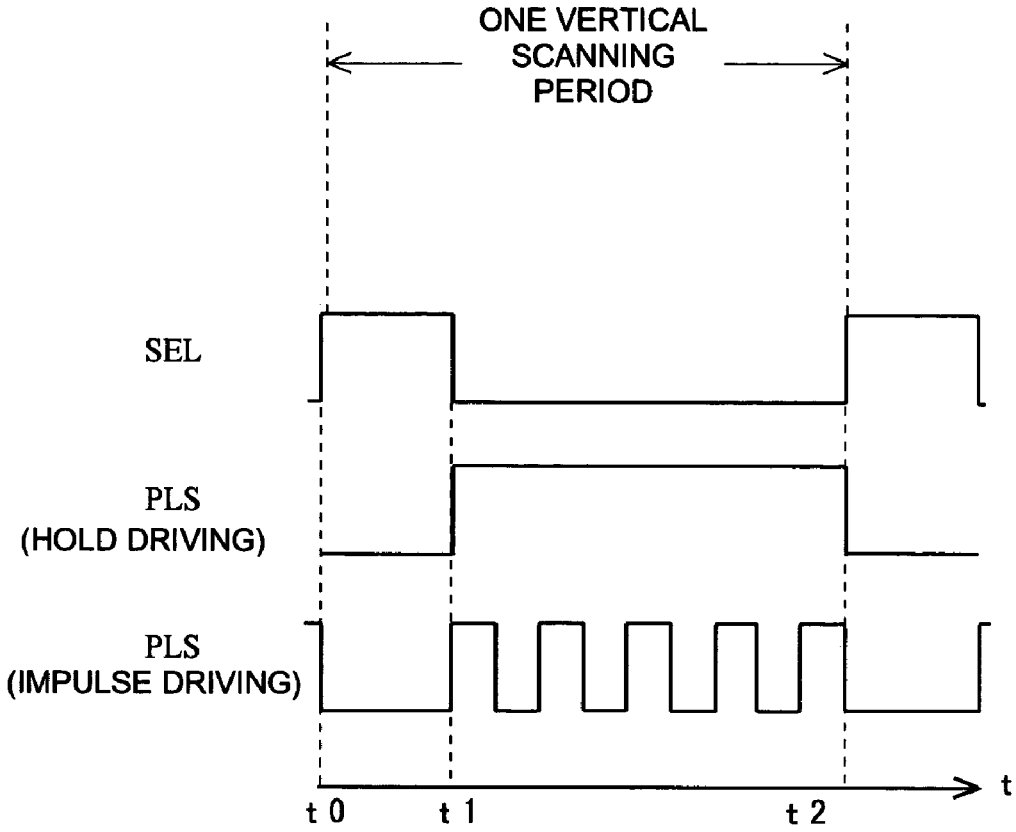
FIG. 16 is a timing chart for driving a pixel according to the fourth embodiment.

FIG. 16 is a timing chart for driving the pixel 2 according to this embodiment. First, at the timing t0, the scanning signal SEL rises to H level, and the switching transistor T1 is turned on. As a result, the data voltage Vdata supplied to the data line X is applied to one electrode of the capacitor C through the switching transistor T1, and charge corresponding to the data voltage Vdata is accumulated in the capacitor C (the data writing). In the time period from the timing t0 to the timing t1, since the pulse signal PLS is kept in L level, the control transistor T5 is kept in the off state. Therefore, since the current path of the driving current Ioled to the organic EL element OLED is cut off, the organic EL element OLED does not emit light in the time period t0 to t1.

In the time period from the timing t1 to the timing t2, the driving current Ioled corresponding to the charge accumulated in the capacitor C flows in the organic EL element OLED, so that the organic EL element OLED emits light. At the timing t1, the scanning signal SEL drops to L level, and the switching transistor T1 is turned off. As a result, application of the data voltage Vdata to one electrode of the capacitor C is stopped, but the voltage equivalent to the gate voltage Vg is applied to the gate of the driving transistor T4 due to the charge accumulated in the capacitor C.

In synchronization with the drop of the scanning signal SEL at the timing t1, the pulse signal PLS which had previously L level turns to any one of a pulse shape and a hold shape (H level), in accordance with the drive mode of the pixel 2. When the impulse driving is instructed through the drive mode signal DRTM (DRTM=H), the pulse signal PLS turns to a pulse waveform. As a result, since the control transistor T5 provided in the current path of the driving current Ioled is repeatedly turned on and off in the driving period t1 to t2 in the impulse driving, the current path of the driving current Ioled is repeatedly cut off. Accordingly, the organic EL element OLED is impulse-driven.

On the other hand, when the hold driving is instructed through the drive mode signal DRTM (DRTM=L), the pulse signal PLS turns to a hold shape to be normally H level. As a result, since the control transistor T5 is normally turned on in the driving period t1 to t2 in the hold driving, the current path of the driving current Ioled is held. Accordingly, the organic EL element OLED is hold-driven.

According to this embodiment, as described above, similarly to the aforementioned embodiments, the drive modes depending upon targets to be displayed in the display unit 1 can be selected in a unit of scanning line. Therefore, similarly to the aforementioned embodiments, it is possible to further accomplish improvement of the overall display quality of the display unit 1, and also to suppress increase of the circuit scale due to addition of the selection function. Furthermore, in this embodiment, a start timing of converting the waveform of the pulse signal PLS into a pulse shape may be the same as the drop timing t1 of the scanning signal SEL, but may be set to be earlier than the drop timing by a predetermined time, specifically in consideration of stability in writing low gradation data.

This embodiment is directed to a construction of a pixel circuit for driving the pixel circuit employing the voltage programming method. In this embodiment, one horizontal line Y comprises two scanning lines to be supplied with the first scanning signal and the second scanning signal, respectively, and one signal line to be supplied with the pulse signal PLS.

Figure 17:
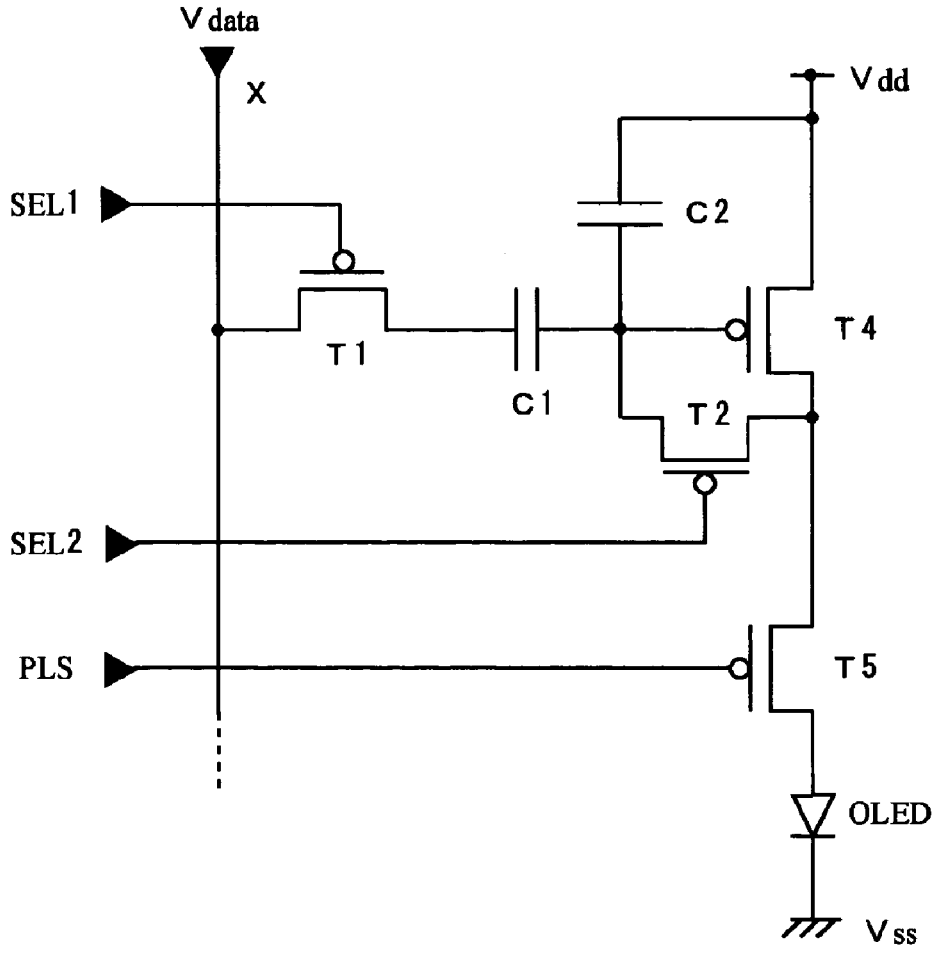
FIG. 17 is a circuit diagram of a pixel according to a fifth embodiment.

FIG. 17 is an exemplary circuit diagram of a pixel 2 according to this embodiment. One pixel 2 can include an organic EL element OLED, four transistors T1, T2, T4, T5, and two capacitors C1, C2. On the other hand, in the pixel circuit according to this embodiment, types of the transistors T1, T2, T4, T5 are all p channel type, but this is only one example, and the present invention is not limited to this example.

A gate of the first switching transistor T1 is connected to the scanning line to be supplied with the scanning signal SEL, and its source is connected to the data line X to be supplied with the data voltage Vdata. A drain of the first switching transistor T1 is connected to one electrode of the first capacitor C1. The other electrode of the first capacitor C1 is connected in common to one electrode of the second capacitor C2, a source of the second switching transistor T2, and a gate of the driving transistor T4. The power source potential Vdd is applied to the other electrode of the second capacitor C2 and a source of the driving transistor T4. A gate of the second switching transistor T2 is supplied with the second scanning signal SEL2, and its drain is connected in common to a drain of the driving transistor T4 and a source of the control transistor T5. The control transistor T5 a gate of which is supplied with the pulse signal PLS is provided between the drain of the driving transistor T4 and the anode of the organic EL element OLED. The Potential Vss is applied to a cathode of the organic EL element OLED.

Figure 18:
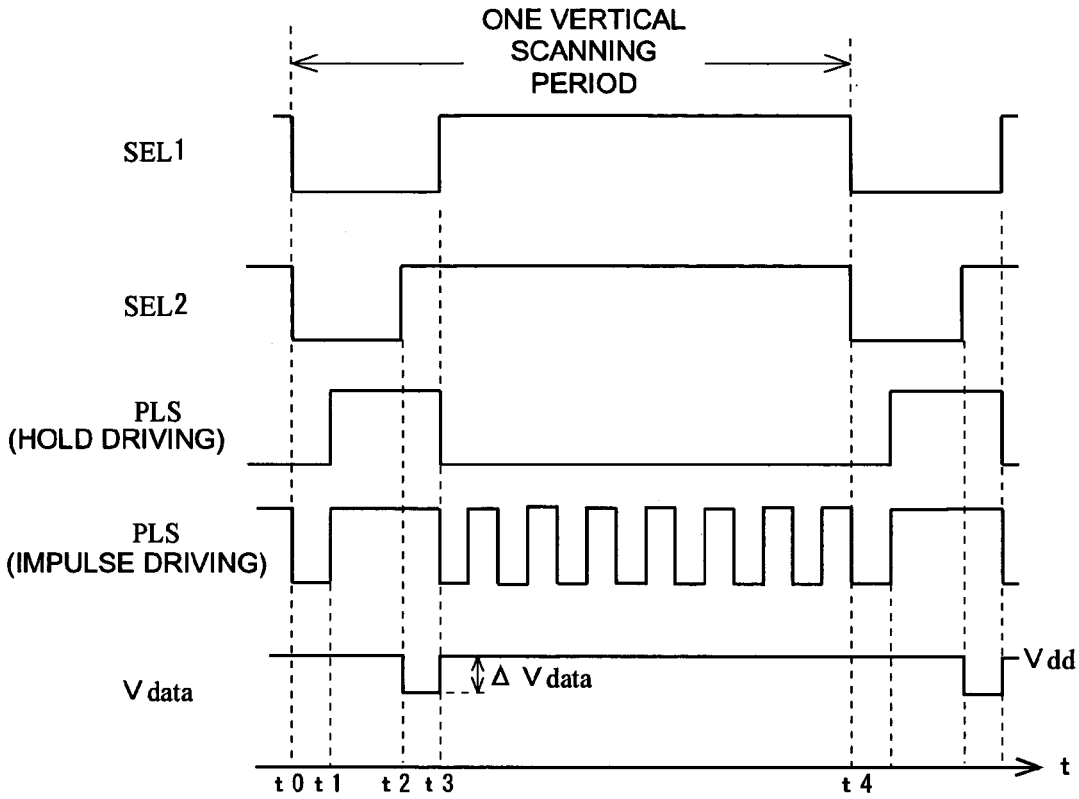
FIG. 18 is a timing chart for driving a pixel according to the fifth embodiment.

FIG. 18 is a timing chart for driving the pixel 2 according to this embodiment. One vertical scanning period t0 to t4 is divided into a time period t0 to t1, an auto zero period t1 to t2, a load data period t2 to t3, and a driving period t3 to t4.

First, in the time period t0 to t1, a potential of the drain of the driving transistor T4 is set to the potential Vss. Specifically, at the timing t0, the first and second scanning signals SEL1, SEL2 all drop to L level, and the first and second switching transistors T1, T2 are all turned on. In this time period t0 to t1, since the power source potential Vdd is fixedly applied to the data line X, the power source potential Vdd is applied to one electrode of the first capacitor C1. Further, in this time period t0 to t1, since the pulse signal PLS is kept in L level, the control transistor T5 is turned on. As a result, the current path through the control transistor T5 and the organic EL element OLED is formed, and the drain potential of the driving transistor T4 turns to the potential Vss. Therefore, the gate voltage Vgs with reference to the source of the driving transistor T4 turns to minus, so that the driving transistor T4 is turned on.

Next, in the auto zero period t1 to t2, the gate voltage Vgs of the driving transistor T4 turns to a threshold voltage Vth. In this time period t1 to t2, since the scanning signals SEL1, SEL2 all have L level, the switching transistors T1, T2 are kept in the on state. At the timing t1, the pulse signal PLS rises to H level and the control transistor T5 is turned off, but the power source potential Vdd from the data line is continuously applied to one electrode of the first capacitor C1. The power source potential Vdd applied to its source is applied to the gate of the driving transistor T4 through its own channel and the second switching transistor T2. As a result, the gate voltage Vgs of the driving transistor T4 is pushed up to its own threshold voltage Vth, and at a time point when the gate voltage Vgs turns to the threshold voltage Vth, the driving transistor T4 is turned off.

As a result, the threshold voltage Vth is applied to the electrodes of two capacitors C1, C2 connected to the gate of the driving transistor T4. On the other hand, since the power source potential Vdd from the data line X is applied to the counter electrodes of the capacitors C1, C2, the potential difference of the capacitors C1, C2 is set to a difference (Vdd−Vth) between the power source potential Vdd and the threshold voltage Vth (auto zero).

In the subsequent load data period t2 to t3, the data writing to the capacitors C1, C2 set to the auto zero is performed. In this time period t2 to t3, the first scanning signal SEL1 is kept in L level similarly to the previous state, and the pulse signal PLS is also kept in H level similarly to the previous state. Therefore, the first switching transistor T1 is in the on state, and the control transistor T5 is in the off state. However, at the timing t2, since the second scanning signal SEL2 rises to H level, the second switching transistor T2 turns from the on state to the off state. Further, a voltage level lowered from the power source potential Vdd by ΔVdata is applied as the data voltage Vdata to the data line X. The amount of variation ΔVdata is a variable value corresponding to the data to be written to the pixel 2, and as a result, the potential difference of the first capacitor C1 is lowered. When the potential difference of the first capacitor C1 is varied like this, the potential difference of the second capacitor C2 is varied in accordance with the relationship of capacitance division of the capacitors C1, C2. The potential difference of the capacitors C1, C2 after the variation is determined by a value obtained by subtracting the amount of variation ΔVdata from the potential difference (Vdd−Vth) in the auto zero period t1 to t2. By variation of the potential difference of the capacitors C1, C2 due to the amount of variation ΔVdata, data is written to the capacitors C1, C2.

Finally, in the driving period t3 to t4, the driving current Ioled corresponding to the charge accumulated in the second capacitor C2 flows in the organic EL element OLED, so tat the organic EL element OLED emits light. At the timing t3, the first scanning signal SEL1 rises to H level, and the first switching transistor T1 turns from the on state to the off state (the second switching transistor T2 is kept in the off state). The voltage of the data line X returns to the power source potential Vdd. As a result, the data line X to which the data power source potential Vdd is applied and one electrode of the first capacitor C1 are separated each other, and the gate and the drain of the driving transistor T4 are separated. Therefore, a voltage (a gate voltage Vgs with respect to the source thereof) corresponding to the charge accumulated in the second capacitor C2 is applied to the gate of the driving transistor T4. An equation for calculating the current Ids (corresponding to the driving current Ioled) flowing in the driving transistor T4 includes the threshold voltage Vth and the gate voltage Vgs of the driving transistor T4 as variables. However, when the potential difference (corresponding to Vgs) of the second capacitor C2 is substituted for the gate voltage Vgs, the threshold voltage Vth is cancelled in the equation for calculating the driving current Ioled. As a result, the driving current Ioled depends on only the amount of variation ΔVdata of the data voltage, not affected by the threshold voltage Vth of the driving transistor T4.

In synchronization with the rising of the first scanning signal SEL1 at the timing t3, the pulse signal PLS which had previously H level turns to any one of a pulse shape and a hold shape (L level), in accordance with the drive mode of the pixel 2. When the impulse driving is instructed through the drive mode signal DRTM (DRTM=H), the pulse signal PLS turns to a pulse waveform. As a result, since the control transistor T5 provided in the current path of the driving current Ioled is repeatedly turned on and off in the driving period t3 to t4 in the impulse driving, the current path of the driving current Ioled is repeatedly cut off. Accordingly, the organic EL element OLED is impulse-driven. On the other hand, when the hold driving is instructed through the drive mode signal DRTM (DRTM=L), the pulse signal PLS turns to a hold shape to be normally L level. As a result, since the control transistor T5 is normally turned on in the driving period t1 to t2 in the hold driving, the current path of the driving current Ioled is kept. Accordingly, the organic EL element OLED is hold-driven.

According to this embodiment, similarly to the aforementioned embodiments, the drive modes depending upon targets to be displayed in the display unit 1 can be selected in a unit of scanning line. Therefore, similarly to the aforementioned embodiments, it is possible to further accomplish improvement of the overall display quality of the display unit 1, and also to suppress increase of the circuit scale due to addition of the selection function. Furthermore, in this embodiment, at the timing t4, the pulse waveform of the pulse signal PLS is finished, but may be finished earlier than the timing t4 by a predetermined time, specifically in consideration of stability in writing low gradation data.

This embodiment is directed to a construction of a pixel circuit for driving the pixel circuit employing the current programming method, and is a modification of the aforementioned pixel circuit of FIG. 8. In this embodiment, one horizontal line Y comprises two scanning lines to be supplied with the first scanning signal SEL1 and the second scanning signal SEL2. One period of the first driving signal INP1 is longer than that of the first driving signal INP1 in the aforementioned embodiments, and the time period t1 to t2 shown in FIG. 20 is substantially set corresponding to one period.

Figure 19:
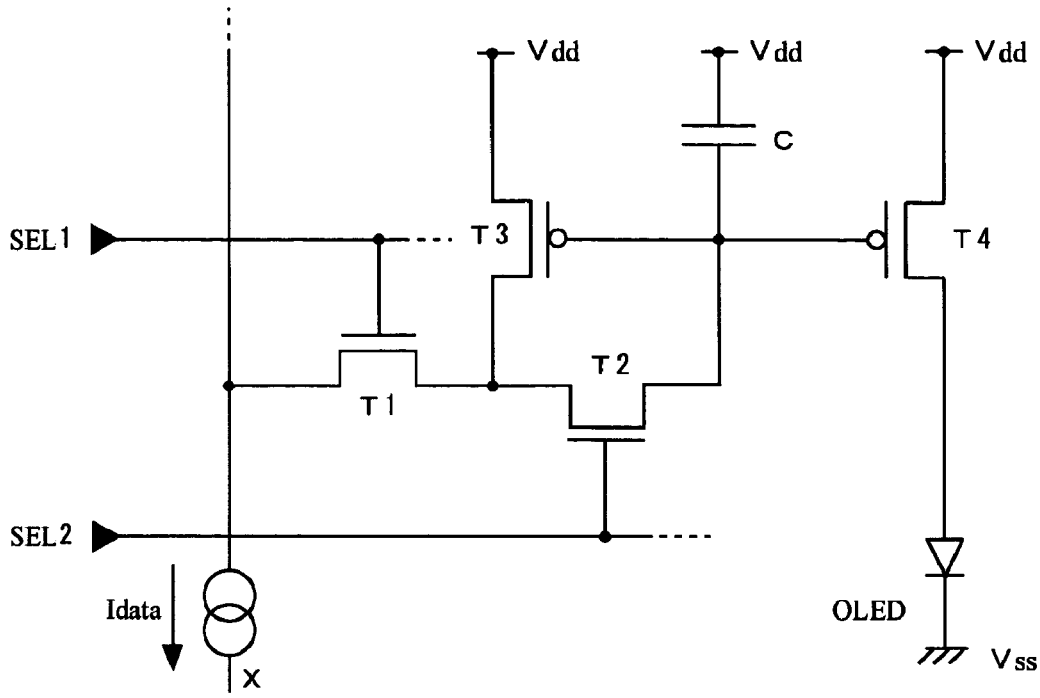
FIG. 19 is a circuit diagram of a pixel according to a sixth embodiment.

FIG. 19 is an exemplary circuit diagram of the pixel 2 according to this embodiment. One pixel 2 comprises an organic EL element OLED, four transistors T1 to T4, and a capacitor C. In this pixel circuit, n channel transistors T1, T2 and p channel transistors T3, T4 are used, but this is only an example, and it should be understood that the present invention is not limited to this example. The pixel circuit shown in FIG. 19 is different from that of FIG. 8, in that the second switching transistor T2 is an n channel type and the control transistor T5 in the current path of the driving current Ioled is omitted. The second switching transistor T2 has also a function of the control transistor T5, in addition to the selection function of the pixel 2 using the second scanning signal SEL2. In addition, the second scanning signal SEL2 has a function of the aforementioned control signal PLS, in addition to the function of the scanning signal.

Figure 20:
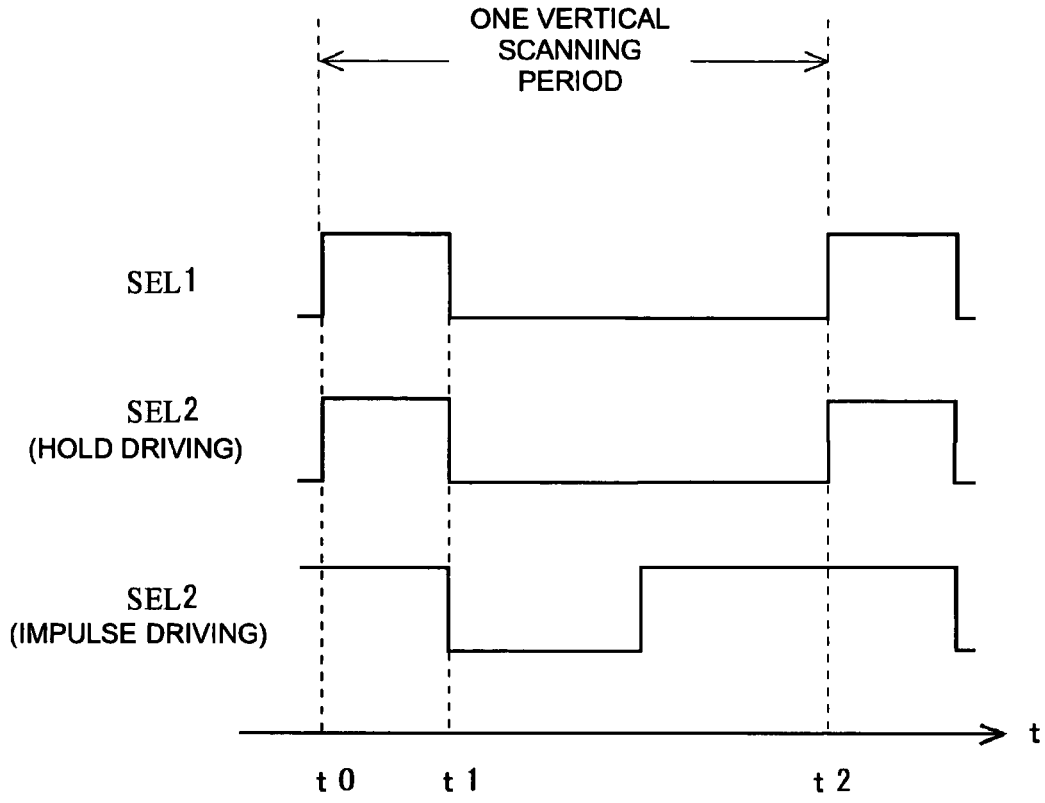
FIG. 20 is a timing chart for driving a pixel according to the sixth embodiment.

FIG. 20 is a timing chart for driving a pixel 2 according to this embodiment. First, in the programming period t0 to t1, through the same operation as in the second embodiment, the data writing to the capacitor C is performed. In the subsequent driving period t1 to t2, the driving current Ioled corresponding to the charge accumulated in the capacitor C flows in the organic EL element OLED, and in accordance with the drive mode, the organic EL element OLED emits light. First, at a driving start timing t1, the scanning signals SEL1, SEL2 all drop to L level, so that the switching transistors T1, T2 are all turned off. As a result, the data line X supplied with the data current Idata and the drain of the driving transistor T4 are electrically separated from each other, and the gate and the drain of the driving transistor T4 are also electrically separated. The voltage equivalent to the gate voltage Vg is applied to the gate of the driving transistor T4, in accordance with the charge accumulated in the capacitor C.

In synchronization with the drop of the first scanning signal SEL1 at the timing t1, the waveform of the second scanning signal SEL2 turns to any one of a pulse shape with the period t1 to t2 corresponding to one period and a hold shape (L level), in accordance with the drive mode of the pixel 2. When the hold driving is instructed by means of the drive mode signal DRTM (DRTM=L), the second scanning signal SEL2 is kept in L level all over the driving period t1 to t2. As a result, in the driving period t1 to t2 in the hold driving, since the driving transistor T4 is driven in accordance with the charge accumulated in the capacitor C and thus the driving current Ioled is continuously supplied to the organic EL element OLED, the organic EL element OLED is hold-driven. On the other hand, when the impulse driving is instructed by means of the drive mode signal DRTM (DRTM=H), the second scanning signal SEL2 is kept in L level in the former part of the driving period t1 to t2, and rises to H level in the latter part of the driving period. Therefore, in the former period before the second scanning signal SEL2 rises, since the driving transistor T4 is driven in accordance with the charge accumulated in the capacitor C and the driving current Ioled is supplied to the organic EL element OLED, the organic EL element OLED emits light. Then, in the latter period after the second scanning signal SEL2 rises, since the second switching transistor T2 is turned on, the current path passing through the transistors T2, T3 is formed between one electrode of the capacitor C and the power source potential Vdd. As a result, since the charge accumulated in the capacitor C is forcibly erased (in other word, the written data is erased) and the driving transistor T4 is turned off, the light emitting of the organic EL element OLED is stopped. That is, in the driving period t1 to t2, the organic EL element OLED emits light by means of the driving current Ioled, and then does not emit light due to the erasing of the charge accumulated in the capacitor C. As a result, the organic EL element OLED performs one light emitting and subsequent one light non-emitting (impulse driving).

According to this embodiment, as described above, the drive modes depending upon targets to be displayed in the display unit 1 can be selected in a unit of scanning line. Accordingly, similarly to the aforementioned embodiments, it is possible to further accomplish improvement of the overall display quality of the display unit 1, and also to suppress increase of the circuit scale due to addition of the selection function. Furthermore, it should be noted that in the aforementioned embodiments, the impulse driving is implemented through cutting off the current path of the driving current Ioled, while in this embodiment, the impulse driving is implemented through erasing the charge accumulated in the capacitor. Therefore, in this embodiment, in one vertical scanning period, since the light emitting and the light non-emitting of the organic EL element OLED can be repeated, the light non-emitting state is continued after the light emitting.

In the aforementioned embodiments, an example in which an organic EL element OLED is used as an electro-optical element has been described. However, the present invention is not limited to this example, but in addition may be applied to an electro-optical element for emitting light with a brightness corresponding to a drive current.

Figure 21:
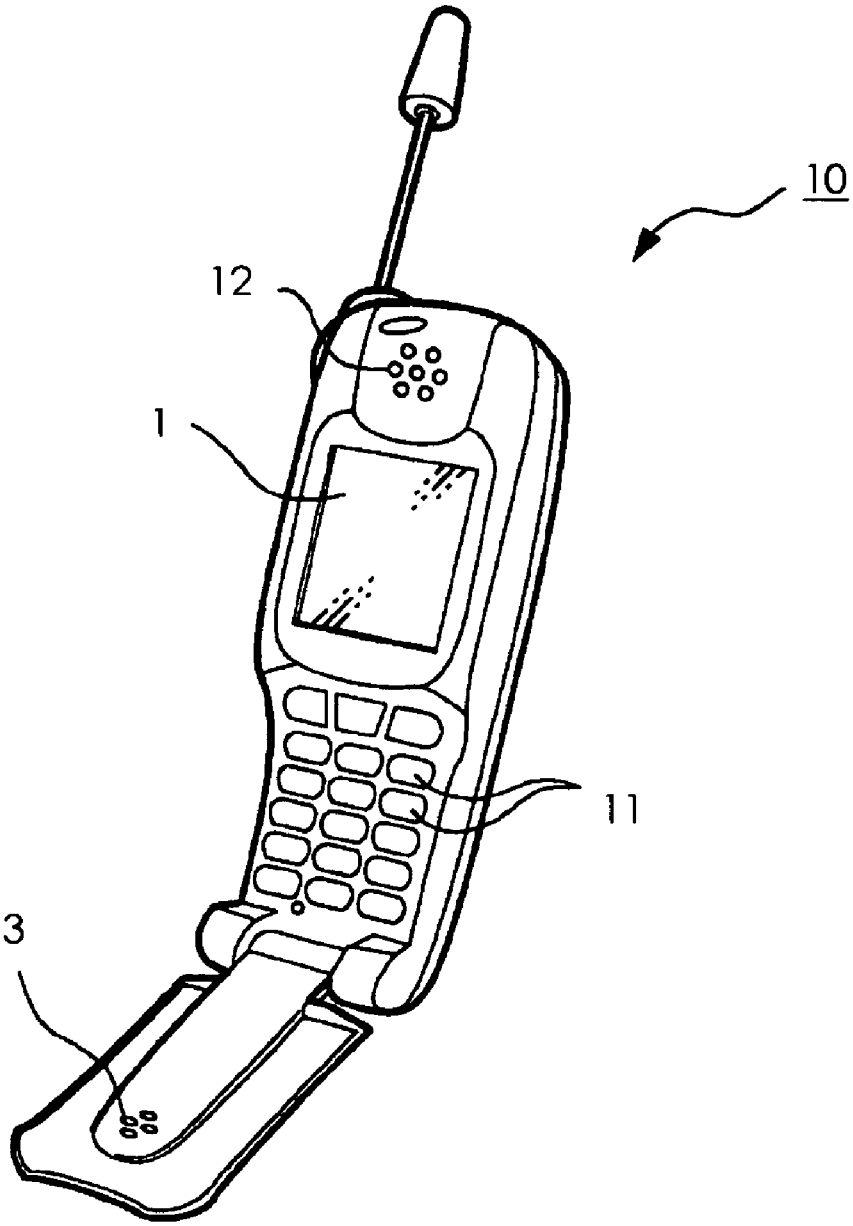
FIG. 21 is a perspective view of a portable phone mounted with the electro-optical device according to these embodiments.

Furthermore, the electro-optical devices according to the aforementioned embodiments may be mounted on various electronic apparatuses, such as projectors, portable phones, mobile terminals, mobile computers, and personal computers. FIG. 21 is, as an example, a perspective view of a portable phone 10 mounted with the electro-optical device according to the embodiments described above. The portable phone 10 includes an earpiece 12, a mouthpiece 13, and the aforementioned display unit 1, in addition to a plurality of manipulation buttons 11. When these electronic apparatuses are mounted with the electro-optical devices described above, it is possible to further enhance the commercial value of the electronic apparatuses, so that it is possible to accomplish improvement in commercial appealing power of the electronic apparatuses in the market.

While this invention has been described in conjunction with specific embodiments thereof, it is evident that many alternatives, modifications, and variations will be apparent to those skilled in the art. Accordingly, preferred embodiments of the invention as set forth herein are intended to be illustrative, not limiting. Various changes may be made without departing from the spirit and scope of the invention.

What is claimed is:

1. An electro-optical device, comprising:

a plurality of scanning lines;

a plurality of data lines;

a plurality of pixels correspondingly provided to intersections of the scanning lines and the data lines, the plurality of pixels forming a plurality of display area, each of the plurality of pixels having storing device that stores data, a driving element that sets a driving current in accordance with the data stored in the storing device, and an electro-optical element that emits light with a brightness corresponding to the set driving current, wherein, each of the pixels further having a control transistor provided in a current path of the driving current to be supplied to the electro-optical element;

a scanning line driving circuit that selects the scanning line corresponding to a pixel in which data should be written, by outputting a scanning signal to the scanning lines;

a data line driving circuit that cooperates with the scanning line driving circuit to output data to the data line corresponding to the pixel in which data should be written; and a drive mode selecting circuit that selects a drive mode of each of the plurality of pixels depending upon the display areas or in a unit of the scanning line, wherein, when a first drive mode is selected as the drive mode, the drive mode selecting circuit drives the electro-optical element for a first light emitting time period shorter than a time period from a time point at which the scanning line corresponding to the pixel in which data should be written is selected to a time point at which the scanning line is next selected, wherein, when a second drive mode other than the first drive mode is selected as the drive mode, the drive mode selecting circuit drives the electro-optical element for a second light emitting time period longer than the first light emitting time period in the time period from a time point at which the scanning line corresponding to the pixel in which data should be written is selected to a time point at which the scanning line is next selected, wherein, the drive mode selecting circuit driving the electro-optical element in the first drive mode and the electro-optical element in the second drive mode, by controlling an on/off state of the control transistor in the time period from a time point at which the scanning line corresponding to the pixel in which data should be written is selected to a time point at which the scanning line is next selected, and wherein, when the first drive mode is selected, the drive mode selecting circuit impulse-drives the electro-optical element by repeatedly cutting off the current path of the driving current using the control transistor in the time period from a time point at which the scanning line corresponding to the pixel in which data should be written is selected to a time point at which the scanning line is next selected.

2. An electro-optical device, comprising:

a plurality of scanning lines;

a plurality of data lines;

a plurality of pixels correspondingly provided to intersections of the scanning lines and the data lines, the plurality of pixels forming a plurality of display areas, each of the plurality of pixels having a capacitor to which data writing is performed, a driving transistor that sets a driving current in accordance with the data written to the capacitor, and an electro-optical element that emits light with a brightness corresponding to the set driving current, wherein, each of the pixels further having a control transistor provided in a current path of the driving current to be sunplied to the electro-optical element;

a scanning line driving circuit that selects the scanning line corresponding to the pixel in which data should be written, by outputting a scanning signal to the scanning lines;

a data line driving circuit that cooperates with the scanning line driving circuit to output data to the data line corresponding to the pixel in which data should be written; and a drive mode selecting circuit that select a drive mode of each of the plurality of pixels depending upon the display areas or in a unit of the scanning line, wherein, when a first drive mode is selected as the drive mode, the drive mode selecting circuit drives the electro-optical element for a first light emitting time period shorter than a time period from a time point at which the scanning line corresponding to the pixel in which data should be written is selected to a time point at which the scanning line is next selected, wherein, when a second drive mode other than the first drive mode is selected as the drive mode, the drive mode selecting circuit drives the electro-optical element for a second light emitting time period longer than the first light emitting time period in the time period from a time point at which the scanning line corresponding to the pixel in which data should be written is selected to a time point at which the scanning line is next selected, wherein, the drive mode selecting circuit driving the electro-optical element in the first drive mode and the electro-optical element in the second drive mode, by controlling an on/off state of the control transistor in the time period from a time point at which the scanning line corresponding to the pixel in which data should be written is selected to a time point at which the scanning line is next selected, and wherein, when the first drive mode is selected, the drive mode selecting circuit impulse-drives the electro-optical element by repeatedly cutting off the current path of the driving current using the control transistor in the time period from a time point at which the scanning line corresponding to the pixel in which data should be written is selected to a time point at which the scanning line is next selected.

3. The electro-optical device according to claim 2, the drive mode selecting circuit impulse-driving the electro-optical element when the first drive mode is selected, and hold-driving the electro-optical element when the second drive mode is selected.

4. The electro-optical device according to claim 2, wherein, when the second drive mode is selected, the drive mode selecting circuit hold-drives the electro-optical element, by holding the current path of the driving current using the control transistor in the time period from a time point at which the scanning line corresponding to the pixel in which data should be written is selected to a time point at which the scanning line is next selected.

5. The electro-optical device according to claim 2, wherein, when the first drive mode is selected, the drive mode selecting circuit impulse-drives the electro-optical element by supplying the driving current to the electro-optical element in accordance with the data written to the capacitor and then erasing the data written to the capacitor in the time period from a time point at which the scanning line corresponding to the pixel in which data should be written is selected to a time point at which the scanning line is next selected.

6. The electro-optical device according to claim 5, wherein, when the second drive mode is selected, the drive mode selecting circuit hold-drives the electro-optical element by continuously supplying the driving current to the electro-optical element in accordance with the data written to the capacitor in the time period from a time point at which the scanning line corresponding to the pixel in which data should be written is selected to a time point at which the scanning line is next selected.

7. The electro-optical device according to claim 2, the data line driving circuit outputting the data as a data current to the data lines, each of the pixels further having a programming transistor, and the programming transistor carrying out the data writing to the capacitor on the basis of a gate voltage that is generated due to carrying data current flowing in a channel of the programming transistor.

8. The electro-optical device according to claim 7, the driving transistor also serving as the programming transistor.

9. The electro-optical device according to claim 2, the data line driving circuit outputting the data as a data voltage to the data line, and the data writing to the capacitor being carried out on the basis of the data voltage.

10. The electro-optical device according to claim 2, the drive mode selecting circuit outputting a pulse signal of controlling the driving of the electro-optical element on the basis of a drive mode signal of specifying the drive mode, and the drive mode selecting circuit outputting a signal having a pulse shape in which a high level and a low level are alternately repeated as a pulse signal when the first drive mode is selected, and outputs a signal having a waveform other than that in the first drive mode as the pulse signal when the second drive mode is selected.

11. The electro-optical device according to claim 10, the drive mode selecting circuit comprising:

a flip-flop that holds a level of the drive mode signal at a timing when the scanning signal is varied;

a selecting section that selects and outputs any one of a first driving signal having a pulse shape in which a high level and a low level are alternately repeated and a second driving signal having a waveform other than that of the first driving signal, in accordance with the level held in the flip flop; and a logic circuit that outputs the pulse signal on the basis of the signal output from the selecting section and a control signal synchronized with the scanning signal and having a logic level opposite to that of the scanning signal.

12. An electronic apparatus mounted with the electro-optical device according to claim 1.

13. A method of driving an electro-optical device, comprising a plurality of pixels correspondingly provided to intersections of scanning lines and data lines, the plurality of pixels forming a plurality of display areas, each of the plurality of pixels having a storing device that stores data, a driving element that sets a driving current in accordance with the data stored in the storing device, and an electro-optical element that emits light with a brightness corresponding to the set driving current, a drive mode of each of the plurality of pixels being selected, the method comprising:

a first step of, when a first drive mode is selected, based upon the display areas or in a unit of a scanning line, as the drive mode, driving the electro-optical element for a first light emitting time period shorter than a time period from a time point at which a scanning line corresponding to the pixel in which data should be written is selected to a time point at which the scanning line is next selected, wherein, in the first step, the electro-optical element being impulse-driven by supplying the driving current to the electro-optical element in accordance with the data written to the capacitor and then erasing the data written to the capacitor in the time period from a time point at which the scanning line corresponding to the pixel in which data should be written is selected to a time point at which the scanning line is next selected; and a second step of, when a second drive mode other than the first drive mode is selected, based upon the display areas or in a unit of the scanning line, as the drive mode, driving the electro-optical element for a second light emitting time period longer than the first light emitting time period in the time period from a time point at which the scanning line corresponding to the pixel in which data should be written is selected to a time point at which the scanning line is next selected, wherein, in the second step, the electro-optical element being hold-driven by continuously supplying the driving current to the electro-optical element in accordance with the data written to the capacitor in the time period from a time point at which the scanning line corresponding to the pixel in which data should be written is selected to a time point at which the scanning line is next selected.

14. A method of driving an electro-optical device, comprising a plurality of pixels correspondingly provided to intersections of scanning lines and data lines, the plurality of pixels forming a plurality of display areas, each of the plurality of pixels having a capacitor to which data writing is performed, a driving transistor for setting a driving current in accordance with the data written to the capacitor, and an electro-optical element that emits light with a brightness corresponding to the set driving current, a drive mode of each of the plurality of pixels being selected, the method comprising:

a first step of, when a first drive mode is selected, based upon the display areas or in a unit of a scanning line, as the drive mode, driving the electro-optical element for a first light emitting time period shorter than a time period from a time point at which a scanning line corresponding to the pixel in which data should be written is selected to a time point at which the scanning line is next selected, wherein, in the first step, the electro-optical element being impulse-driven by supplying the driving current to the electro-optical element in accordance with the data written to the capacitor and then erasing the data written to the capacitor in the time period from a time point at which the scanning line corresponding to the pixel in which data should be written is selected to a time point at which the scanning line is next selected; and a second step of, when a second drive mode other than the first drive mode is selected, based upon the display areas or in a unit of the scanning line, as the drive mode, driving the electro-optical element for a second light emitting time period longer than the first light emitting time period in the time period from a time point at which the scanning line corresponding to the pixel in which data should be written is selected to a time point at which the scanning line is next selected, wherein, in the second step, the electro-optical element being hold-driven by continuously supplying the driving current to the electro-optical element in accordance with the data written to the capacitor in the time period from a time point at which the scanning line corresponding to the pixel in which data should be written is selected to a time point at which the scanning line is next selected.

15. The method of driving an electro-optical device according to claim 14, in the first step, the electro-optical element being impulse-driven, and in the second step, the electro-optical element being hold-driven.

16. The method of driving an electro-optical device according to claim 14, each of the pixels further having a control transistor provided in a current path of the driving current to be supplied to the electro-optical element, and in the first step, the electro-optical element being impulse-driven by repeatedly cutting off the current path of the driving current using the control transistor in the time period from a time point at which the scanning line corresponding to the pixel in which data should be written is selected to a time point at which the scanning line is next selected.

17. The method of driving an electro-optical device according to claim 16, in the second step, the electro-optical element being hold-driven by holding the current path of the driving current using the control transistor in the time period from a time point at which the scanning line corresponding to the pixel in which data should be written is selected to a time point at which the scanning line is next selected.

18. The method of driving an electro-optical device according to claim 14, each of the pixels further having a programming transistor, and also data is supplied as a data current to each of the pixels, and the data writing to the capacitor being carried out on the basis of a gate voltage generated due to the data current flowing in a channel of the programming transistor.

19. A method of driving an electro-optical device according to claim 14, data being supplied as a data voltage to each of the pixels, and the data writing to the capacitor being carried out on the basis of the data voltage.

* * * * *